US005695001A

United States Patent [19]

Blazek et al.

[11] Patent Number: 5,695,001

[45] Date of Patent: Dec. 9, 1997

[54] ELECTROMAGNETIC CONFINING DAM FOR CONTINUOUS STRIP CASTER

[75] Inventors: Kenneth E. Blazek, Crown Point, Ind.; Walter F. Praeg, Palos Park, Ill.

[73] Assignee: Inland Steel Company, Chicago, Ill.

[21] Appl. No.: 619,914

[22] Filed: Mar. 20, 1996

[51] Int. Cl.[6] ..... B22D 11/06; B22D 27/02

[52] U.S. Cl. ..... 164/467; 164/428; 164/480; 164/503

[58] Field of Search ..... 164/467, 503, 164/428, 480

[56] References Cited

U.S. PATENT DOCUMENTS

| | | | |
|---|---|---|---|
| 4,936,374 | 6/1990 | Pareg | 164/503 |
| 4,974,661 | 12/1990 | Lari et al. | 164/503 |
| 5,197,534 | 3/1993 | Gerber et al. | 164/467 |
| 5,251,685 | 10/1993 | Praeg | 164/467 |
| 5,279,350 | 1/1994 | Gerber | 164/467 |
| 5,385,201 | 1/1995 | Praeg | 164/467 |
| 5,487,421 | 1/1996 | Gerber | 164/467 |
| 5,495,886 | 3/1996 | Kolesnichenko | 164/467 |

FOREIGN PATENT DOCUMENTS 43 07 850 C1 6/1994 Germany .

*Primary Examiner*—Kuang Y. Lin

*Attorney, Agent, or Firm*—Marshall, O'Toole, Gerstein, Murray & Borun

[57] ABSTRACT

An electromagnetic dam is employed to confine a vertically disposed pool of molten metal at the open end of the space between two counter-rotating, casting rolls in a continuous strip caster. The dam comprises three magnetic flux conductors each having a pair of spaced-part surfaces adjacent to and facing in the direction of the pool of molten metal. Two such surfaces of a first flux conductor define a relatively wide air gap adjacent the top part of the molten metal pool; two such surfaces of a second flux conductor define a relatively narrow air gap adjacent the bottom part of the pool, at the nip between the casting rolls; and two pool-facing surfaces of a third magnetic flux conductor are disposed between the spaced-apart surfaces of the first flux conductor in the wide air gap. Coils, for conducting a time-varying electric current, are associated with the three magnetic flux conductors to develop, at the air gaps, horizontal magnetic fields which confine the molten metal pool at the open end of the space between the casting rolls.

42 Claims, 10 Drawing Sheets

FIG. 1
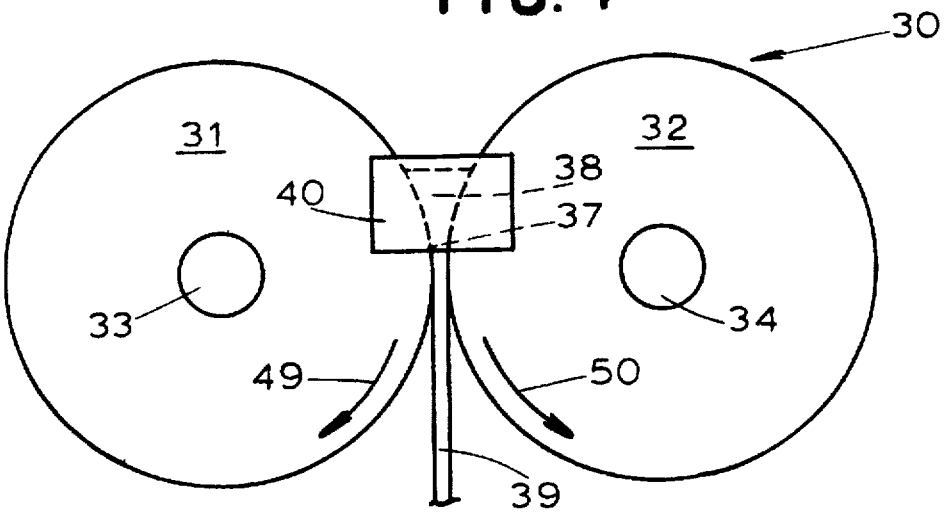
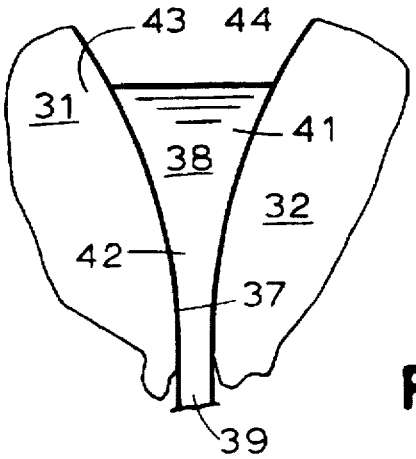
FIG. 2
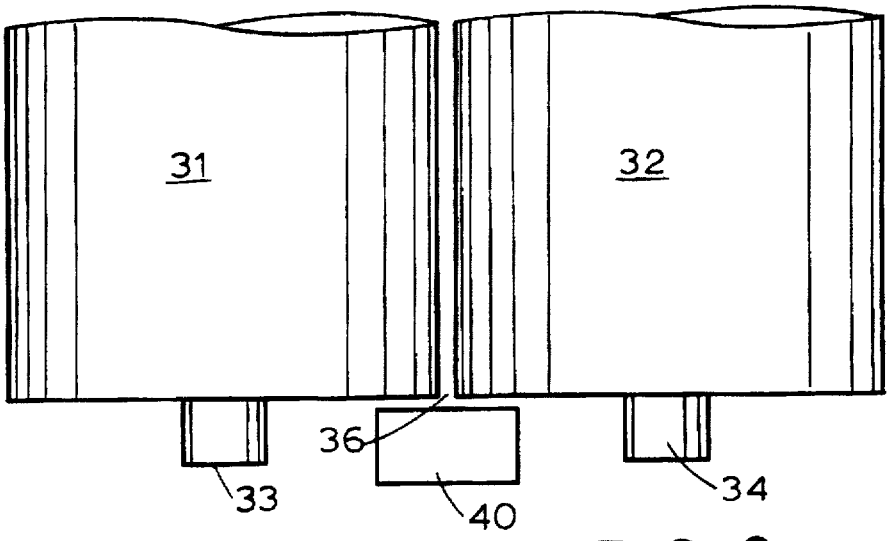
FIG. 3

FIG. 11
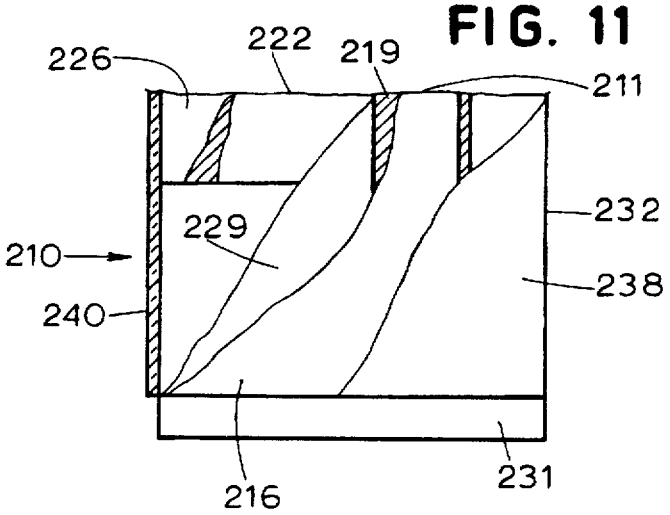
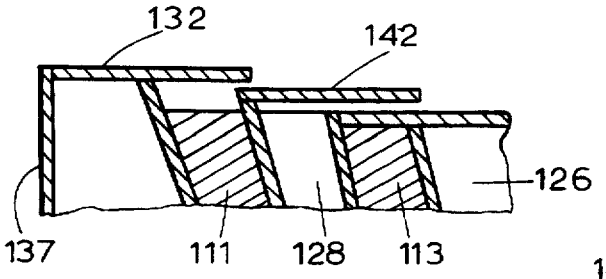
FIG. 14
FIG. 15
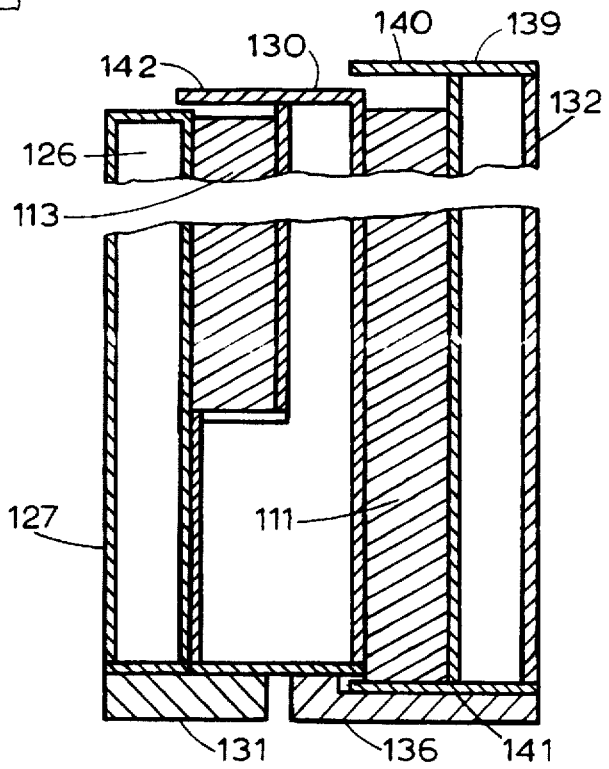

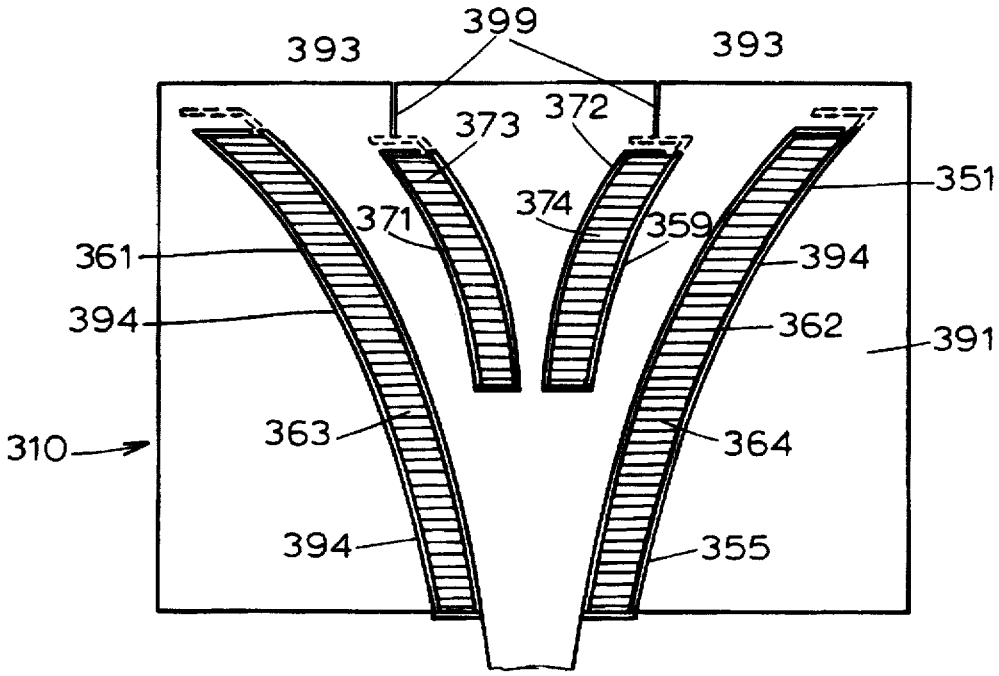
FIG. 18
FIG. 20
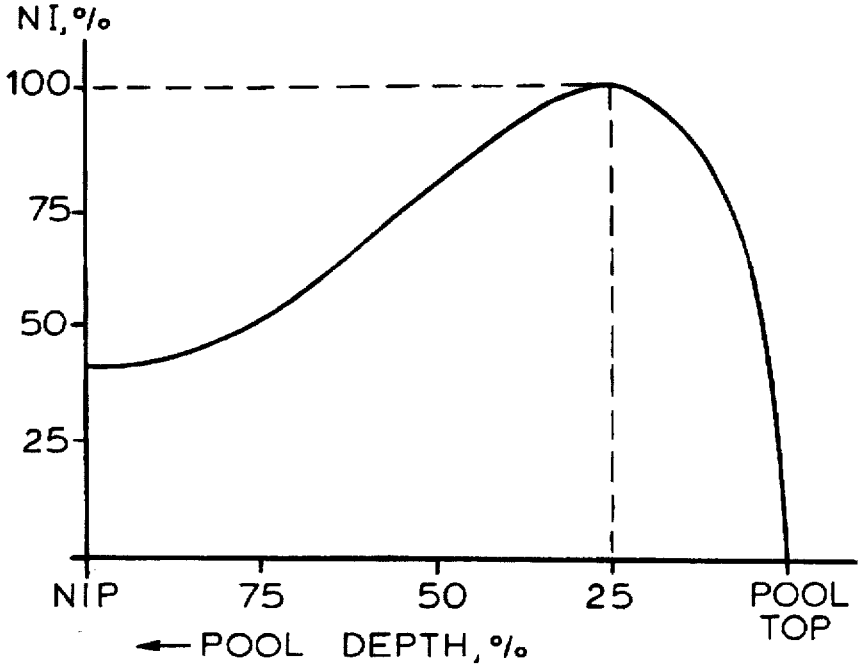

ELECTROMAGNETIC CONFINING DAM FOR CONTINUOUS STRIP CASTER

BACKGROUND OF THE INVENTION

The present invention relates generally to electromagnetic confining dams and more particularly to an electromagnetic confining dam for use with a continuous strip caster.

A continuous strip caster is employed to continuously cast molten metal into a solid strip, e.g. steel strip. A continuous strip caster typically comprises a pair of horizontally disposed counter-rotating, casting rolls having a vertically extending space therebetween for receiving and containing a pool of molten metal. The space defined by the rolls tapers arcuately in a downward direction toward the nip between the rolls. The casting rolls are cooled and in turn cool the molten metal as the molten metal descends through the space, exiting as a solid metal strip below the nip between the rolls.

The space between the rolls has an open end adjacent each end of a roll. The molten metal is unconfined by the rolls at each open end of the space. To prevent molten metal from escaping outwardly through the open end of that space, electromagnetic confining dams have been employed. One type of electromagnetic dam utilizes a magnetic flux conductor associated with an electrically conductive coil and having a pair of spaced-apart magnet poles or end surfaces facing in the direction of the pool of molten metal and located adjacent the pool. The electromagnet is energized by the flow through the coil of a time-varying current (e.g., alternating current) and provides a time-varying (alternating ) magnetic field which extends across the open end of the space between the poles or spaced-apart surfaces of the magnetic flux conductor. The magnetic field exerts a magnetic confining pressure on the pool of molten metal at the open end of the space between the rolls. The magnetic field can be either horizontal or vertical, depending upon the disposition of the poles of the magnet. Examples of electromagnetic dams which produce a horizontal field are described in Pareg [sic] U.S. Pat. No. 4,936,374 and in Praeg U.S. Pat. No. 5,251,685. Examples of electromagnetic dams which produce a vertical magnetic field are described in Lari et al. U.S. Pat. No. 4,974,661.

Another expedient for magnetically confining molten metal at the open end of the space between the casting rolls is to locate, adjacent the open end of that space, a vertically disposed confining coil having a front surface facing the open end of that space, adjacent thereto. A time-varying electric current is flowed through the confining coil to directly generate a horizontal magnetic field which extends from the front surface of the confining coil through the open end of the space between the casting rolls and exerts a magnetic confining pressure on the pool of molten metal at the open end of that space. Enveloping a substantial part of the confining coil, other than the front surface thereof, is a member composed of magnetic material. This magnetic member substantially diminishes the time-varying electric current which flows along surfaces of the confining coil other than its front surface, thereby concentrating the current on the coil's front surface; the magnetic member also constitutes a magnetic flux conductor which provides a low reluctance return path for the magnetic field. A shield composed of non-magnetic, electrically conductive material (e.g. copper) substantially envelopes the magnetic flux conductor and confines that part of the magnetic field which is outside of the low reluctance return path to substantially the open end of the space between the casting rolls. Embodiments of a coil-type of magnetic confining dam are described in Gerber et al. U.S. Pat. No. 5,197,534, in Gerber U.S. Pat. No. 5,279,350 and in Gerber U.S. Pat. No. 5,487,421. The disclosures of all the patents identified above are incorporated herein by reference.

The open end of the space between the two casting rolls, and the molten metal pool at that location, have a width which tapers arcuately in a downward direction. That width is greatest at the top of the molten metal pool and narrowest at the nip between the two casting rolls.

The magnetic flux conductor has spaced-apart surfaces, adjacent the open end of the space between the casting rolls, and these surfaces face in the direction of the molten metal pool. The air gap defined by these spaced-apart surfaces tapers arcuately in a downward direction, corresponding to the taper at the open end of the space between the casting rolls. The width of this air gap is greatest at the top of the molten metal pool and narrowest at the nip between the two casting rolls.

The magnetic pressure exerted at a given vertical level of the electromagnetic confining dam is dependent upon the magnetic field (B), at that location, which in turn is dependent upon the factors reflected by the following equation.

$$B = \frac{kNI}{lg}$$

where:

B is the magnetic field k is a constant

N is the number of turns in the coil of the electromagnet

I is the current flow through the coil lg is the width of the air gap between the spaced-apart surfaces of the magnetic flux conductor.

From the foregoing equation, it is apparent that, for a given current (I), the magnetic field (B) and the resulting magnetic pressure decreases with increasing air gap width (lg). For a given coil with a given number of turns (N) and a given air gap width (lg), the magnetic field (B) can be increased by increasing the current (I).

The upper or top part of the molten metal pool, below but relatively near the top surface of the pool, is relatively wide. Of the same relative width is the air gap (lg) defined by the spaced-apart surfaces of the magnetic flux conductor adjacent the upper part of the molten metal pool. Accordingly, at that upper location, in order to produce a magnetic field (B) which will provide the desired magnetic pressure, there should be a relatively large current (I) flowing through the confining coil described in the preceding paragraph, in accordance with the equation NI=lg B/k. The maximum current is required at a location about 25% below the top surface of the pool.

At the substantially lower vertical location corresponding to the nip between the two casting rolls, the molten metal pool is relatively narrow. The ferrostatic pressure of the molten metal (e.g. steel) is at a maximum at the nip. Accordingly, the magnetic pressure there must also be at a maximum. However, the width of the air gap (lg), defined by the spaced-apart surfaces of the magnetic flux conductor adjacent the nip, is quite narrow. Therefore, the magnetic pressure necessary there can usually be developed with less current (I) than that required to develop the magnetic pressure needed at higher vertical locations where the air gap is much wider. In other words, (a) the current required to develop the desired magnetic pressure, at certain locations below but near the top surface of the molten metal pool, is greater than (b) the current required at a lower location adjacent the nip between the casting rolls. In such instances, other expedients have been employed to provide containment of the molten metal pool at the upper location.

One such expedient employs a combination of electromagnetic and mechanical containment dams to contain the top part of the molten metal pool. In this arrangement, the large air gap, between the spaced-apart surfaces of the magnetic flux conductor, is partially bridged by an element composed of magnetic material and disposed between the spaced-apart surfaces but closer to the pool of molten metal than those surfaces. This partial bridge has two opposite end surfaces each of which, together with a respective one of the two spaced-apart surfaces of the magnetic flux conductor, defines a relatively narrow air gap. These two narrow air gaps have a total width substantially less than the width of the air gap between the spaced-apart surfaces of the magnetic flux conductor. The magnetic field developed at each of these two relatively narrow air gaps is sufficient to contain those parts of the molten metal opposite these narrow air gaps. The rest of the molten metal, opposite the partial bridge, is contained by a mechanical dam composed of liquid-cooled copper covered with a refractory material and disposed between the partial bridge and the pool of molten metal. The mechanical dam juts into the space between the casting rolls, through the open end of the space, and there is a clearance between the mechanical dam and each roll.

There are problems with the molten metal containment arrangement described in the preceding paragraph. For example, molten metal can solidify against the refractory cover on the liquid-cooled mechanical dam, and the solidified metal can grow from the mechanical dam and bridge the clearance between the dam and a rotating casting roll. In such a case, rotation of the casting roll can cause solidified bridging metal to rip off the refractory cover on the liquid-cooled mechanical dam, which is undesireable, and there can be other operational problems including electrical shorts.

SUMMARY OF THE INVENTION

The problems described above are overcome by employing an electromagnetic confining dam in accordance with the present invention. The electromagnetic confining dam comprises three magnetic flux conductors. A first magnetic flux conductor has a relatively wide upper part facing the top part of the molten metal pool, when the latter is at its maximum height, and defines a relatively wide air gap. There is a second magnetic flux conductor located below the first magnetic flux conductor. The second magnetic flux conductor has a relatively narrow part, facing the bottom part of the molten metal pool at the nip between the casting rolls, and defines a relatively narrow air gap. A third magnetic flux conductor is located in the relatively wide air gap defined by the first magnetic flux conductor.

Each of the first and second magnetic flux conductors has a pair of spaced-apart surfaces adjacent to and facing in the direction of the pool of molten metal. The third magnetic flux conductor has a pair of spaced-apart surfaces located between the spaced-apart surfaces of the first magnetic flux conductor; the spaced-apart surfaces of the third magnetic flux conductor are adjacent to and face the top part of the pool of molten metal.

There is a coil or a coil portion associated with each of the magnetic flux conductors. A time-varying electric current is flowed through the coil associated with the second magnetic flux conductor. This develops, at the relatively narrow air gap, a horizontal magnetic field sufficient to electromagnetically contain the pool of molten metal at the nip between the casting rolls, when the pool is at its maximum height.

A time-varying electric current is also flowed through the coil or coils associated with the first and third magnetic flux conductors. The flow of time-varying current through the coil associated with the first magnetic flux conductor develops, at the relatively wide air gap, a horizontal magnetic field comprising magnetic flux. The flow of time-varying current through the coil associated with the third magnetic flux conductor develops, at the relatively wide air gap, additional magnetic flux which augments at least part of the magnetic flux developed by the first magnetic flux conductor and its associated coil. The first and third magnetic flux conductors and the associated coil of each cooperate to develop, at the relatively wide air gap, a magnetic field for confining the top part of the molten metal pool when the pool is at its maximum height.

The second magnetic flux conductor provides a low reluctance return path for the horizontal magnetic field developed at the narrow gap. The first and third magnetic flux conductors provide low reluctance return paths for the horizontal magnetic field developed at the wide air gap. Each of the three magnetic flux conductors is substantially enclosed by non-magnetic, electrically conductive material, except for the spaced-apart surfaces, on the magnetic flux conductors, which face in the direction of the molten metal pool. The non-magnetic, electrically conductive material confines that part of a magnetic field which is outside of its low reluctance return path to substantially the air gap at which the field is developed.

The entire molten metal pool, from top to bottom, is confined solely by the magnetic confining apparatus. The continuous strip caster does not include any functional mechanical expedient for confining the pool of molten metal at the open end of the space between the casting rolls.

In some embodiments, the coils associated with the magnetic flux conductors can all be totally remote from the pool of molten metal. In other embodiments, a coil associated with the magnetic flux conductors comprises at least one coil portion having a front surface which (a) faces the open end of the space between the casting rolls and (b) is sufficiently proximate to the open end to enable the direct generation of a horizontal magnetic field which extends through that open end to the pool of molten metal.

The second magnetic flux conductor may be integral with and comprise a downward extension of the first magnetic flux conductor. In all embodiments, the third magnetic flux conductor terminates downwardly at a location substantially above the downward termination of the second magnetic flux conductor.

In some embodiments, there can be a single coil associated with all three magnetic flux conductors, or there can be two or more coils, each of which is associated with either one or more magnetic flux conductors.

Other features and advantages are inherent in the structure claimed and disclosed or will become apparent to those skilled in the art from the following detailed description in conjunction with the accompanying diagrammatic drawing.

BRIEF DESCRIPTION OF THE DRAWING

FIG. 1 is an end view of a continuous strip caster having an electromagnetic confining dam in accordance with the present invention;

FIG. 2 is an enlarged, fragmentary end view of a portion of the strip caster of FIG. 1;

FIG. 3 is a fragmentary plan view of the strip caster of FIG. 1;

FIG. 11 is a fragmentary side view, partially in section and partially cut away, of the embodiment of FIGS. 9–10;

FIG. 14 is a fragmentary sectional view taken along line 14—14 in FIG. 13, showing the details of a top cover arrangement for the dam;

FIG. 15 is a fragmentary sectional view taken along line 15—15 in FIG. 13, showing the details of a top cover arrangement for the dam;

FIG. 18 is an end view of the embodiment of FIG. 17;

FIG. 20 is graph plotting (a) NI (number of coil turns x current), expressed as a per cent of NI required at a pool depth 25% from the pool's top surface, versus (b) pool depth;

DETAILED DESCRIPTION

Figure 4:
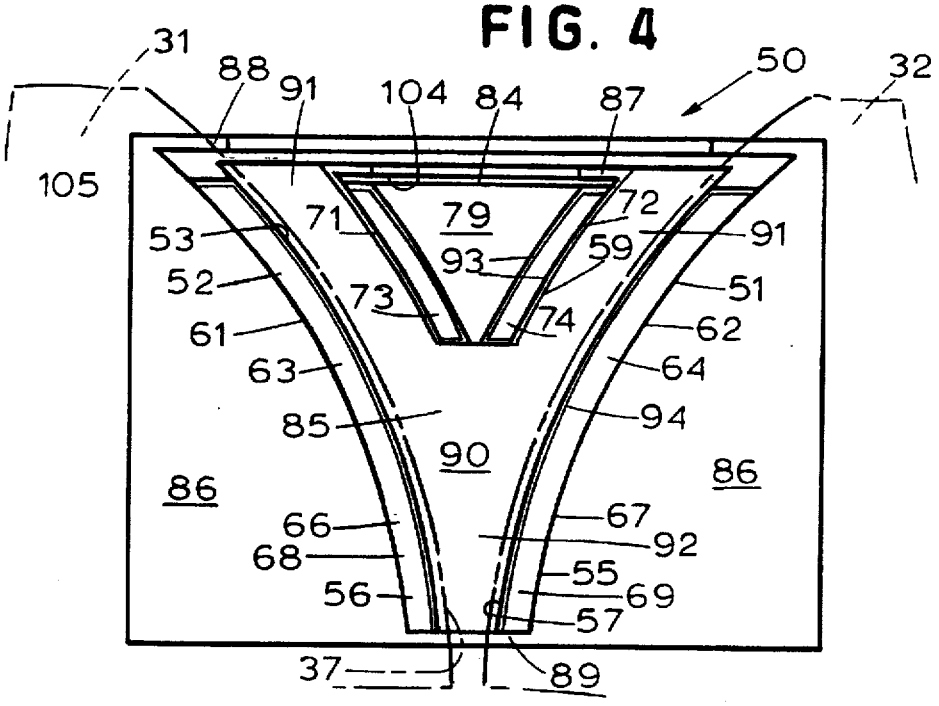
FIG. 4 is an enlarged end view of one embodiment of an electromagnetic confining dam in accordance with the present invention.

Referring initially to FIGS. 1–3, indicated generally at 30 is a strip casting apparatus comprising a pair of horizontally spaced, counter-rotating casting rolls 31, 32 having respective roll shafts 33, 34. Rolls 31, 32 have a vertically extending space 35 between the rolls for containing a pool 38 of molten metal typically composed of steel. Casting rolls 31, 32 have facing surfaces converging downwardly toward a nip 37 between the rolls. The casting rolls comprise structure for accommodating a molten metal pool 38 having a predetermined maximum height and top and bottom parts 41, 42 respectively (FIG. 2). Each of casting rolls 31, 32 has the same radius, and the predetermined maximum height (depth) of molten metal pool 38 is typically a large fraction (e.g. greater than one-half) of the radius of rolls 31, 32). The rolls rotate respectively in the direction of arrows 49, 50 shown in FIG. 1. The rolls are cooled in a conventional manner (not shown) and in turn cool the molten metal which is solidified as it passes through nip 37 between rolls 31, 32, exiting from nip 37 as a solid metal strip 39.

Space 35 between rolls 31, 32 has an open end 36 (FIG. 3), and located adjacent open end 36 is an electromagnetic dam 40 for preventing the escape of molten metal through open end 36 of space 35.

Figure 5A:
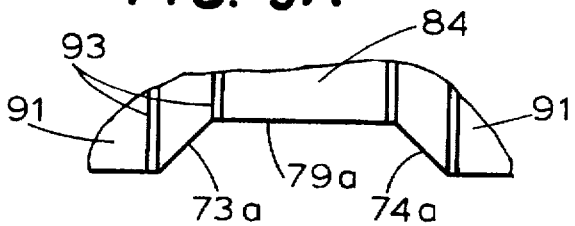
FIG. 5*a* is a fragmentary plan view showing one variation of the embodiment of FIGS. 4–5.
Figure 5:
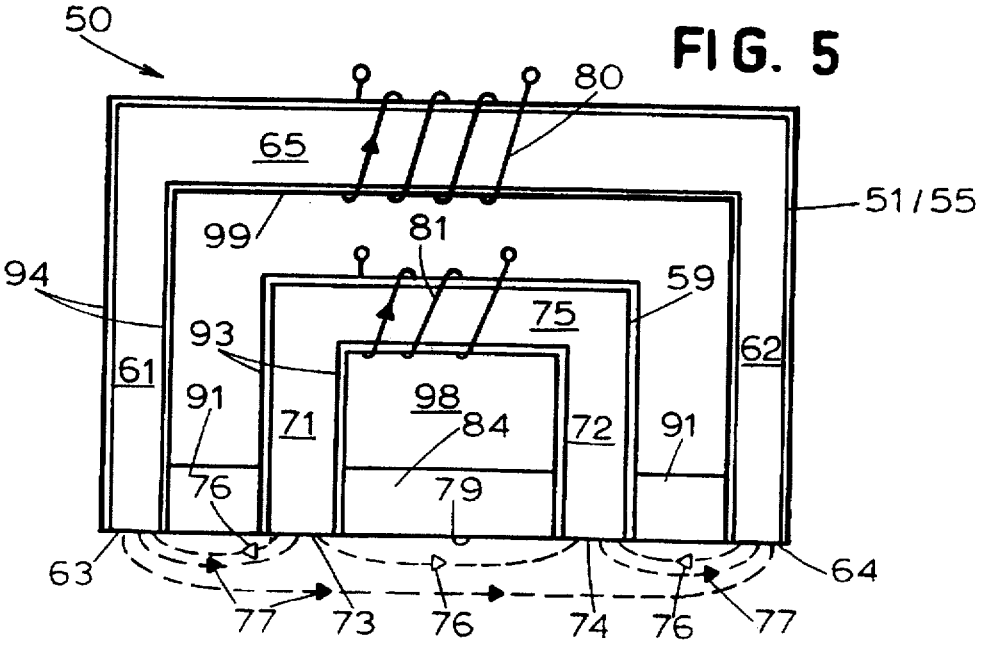
FIG. 5 is a plan view of the embodiment of FIG. 4, with a top cover removed, and showing a pair of coils which would be relatively remote from a pool of molten metal.

There are a number of embodiments of magnetic confining apparatus 40 in accordance with the present invention. One such embodiment, indicated generally at 50 in FIGS. 4–5, is described immediately below. Magnetic confining apparatus 50 comprises a first magnetic flux conductor 51 having a relatively wide upper part 52 facing the top part 41 of molten metal pool 38 (FIG. 2), when the latter is at its maximum height. Wide upper part 52 of first magnetic flux conductor 51 defines a relatively wide air gap 53. A second magnetic flux conductor 55 is located below first magnetic flux conductor 51 and constitutes a downward extension of the latter. Second magnetic flux conductor 55 has a relatively narrow part 56 facing the bottom part 42 of molten metal pool 38 at nip 37 and defines a relatively narrow air gap 57.

Located in relatively wide air gap 53, defined by wide upper part 52 of the first magnetic flux conductor, is a third magnetic flux conductor 59.

First magnetic flux conductor 51 comprises a yoke 65 from which extend a pair of spaced-apart arms 61, 62 each terminating at a respective one of a pair of spaced-apart surfaces 63, 64.

Second magnetic flux conductor 55 comprises a pair of spaced-apart arms 66, 67 (FIG. 4) connected by a yoke (not shown) and each terminating at a respective one of a pair of spaced-apart surfaces 68, 69 (FIG. 4). The arms and the yoke on the second magnetic flux conductor are integral with and comprise downward extensions of the arms and the yoke respectively on first magnetic flux conductor 51.

Third magnetic flux conductor 59 comprises a pair of spaced-apart arms 71, 72 connected by a yoke 75 and each terminating at a respective one of a pair of spaced-apart surfaces 73, 74 adjacent to and facing top part 41 of molten metal pool 38. Yoke 75 and arms 71, 72 on third magnetic flux conductor 59 are separate and discrete from the yoke and arms on each of first and second magnetic flux conductors 51, 55 respectively. The arms and the yoke on third magnetic flux conductor 59 terminate downwardly at a location substantially above the downward termination of the arms and the yoke on second magnetic flux conductor 55 (FIG. 4).

Spaced-apart surfaces 73, 74 of third magnetic flux conductor 59 are located in wide air gap 53 defined between spaced-apart surfaces 63, 64 of first magnetic flux conductor 51, and, as noted above, the spaced-apart surfaces on the third magnetic flux conductor are adjacent to and face top part 41 of molten metal pool 38. The spaced-apart surfaces 63, 64 and 68, 69 on the first and second magnetic flux conductors respectively are located adjacent to and face in the direction of molten pool 38.

The spaced-apart surfaces of the three magnetic flux conductors constitute magnetic pole faces. The magnetic pole faces 63, 64 and 68, 69 of the first and second magnetic flux conductors are directly opposite and face respective rim portions 44 and 43 on casting rolls 32 and 31 (FIG. 2).

As previously noted, magnetic pressure is a function of the magnetic field (B), and the current required to produce a magnetic pressure sufficient to contain the pool of molten metal varies with pool depth and the width of the air gap (lg) in accordance with the equation B=k NI/lg. This is depicted graphically in FIG. 20 which plots (a) NI (number of coil turns x current), expressed as a % of NI required at a pool depth 25% from the pool's top surface, versus (b) pool depth. For a given coil having a given number of coil turns (N), the current (I) required, to produce a magnetic pressure sufficient to contain the molten metal, is a maximum at a pool depth about 25% below the top of the pool, a location where the air gap is relatively wide. At greater depths, the air gap narrows, thereby decreasing the current required to develop a magnetic pressure sufficient to contain the molten metal. At shallower depths, there is some widening of the air gap, but the ferromagnetic pressure drops drastically. In accordance with the present invention, the magnetic pressure required at different pool depths is developed, in the embodiment of FIGS. 4–5, in the manner described below.

A coil 80 is wrapped around the mutual yoke 65 of first and second magnetic flux conductors 51, 55 (FIG. 5). Coil 80 provides a time-varying electric current (alternating current), in electromagnetic association with second magnetic flux conductor 55. This develops, at lower, relatively narrow air gap 57 (FIG. 4), a horizontal magnetic field sufficient to electromagnetically confine bottom part 42 of molten metal pool 38 at nip 37 and above (FIG. 2), when pool 38 is at its maximum height.

Coil 80 also provides a time-varying electric current in electromagnetic association with first magnetic flux conductor 51. The time-varying electric current described in the preceding sentence develops, at relatively wide air gap 53, a horizontal magnetic field comprising magnetic flux.

Coil 81 is wrapped around yoke 75 of third magnetic flux conductor 59 (FIG. 5). Coil 81 provides a time-varying electric current in electromagnetic association with third magnetic flux conductor 59, and this develops, at relatively wide air gap 53, additional magnetic flux which augments at least part of the magnetic flux developed by first magnetic flux conductor 51 and its associated coil 80.

The current flow in coils 80, 81 is in the direction of the arrows on the coils. The flux lines developed by the first and third magnetic flux conductors 51 and 59 are shown in FIG. 5 at 76 and 77, respectively.

Flux 76 flows externally from surface 73 on third magnetic flux conductor 59 to surface 74 thereon and then internally through the third magnetic flux conductor back to surface 73. Flux 76 also flows externally from surface 73 to surface 63 on first magnetic flux conductor 51, then internally through the first magnetic flux conductor to surface 64 thereon, then externally to surface 74 on third magnetic flux conductor 59 and then internally through the third magnetic flux conductor to surface 73 thereon.

Flux 77 flows externally from surface 63 on first magnetic flux conductor 51 to surface 64 thereon and then internally through the first magnetic flux conductor back to surface 63 thereon. Flux 77 also flows externally from surface 63 to surface 73 on third magnetic flux conductor 59, then internally through the third magnetic flux conductor to surface 74 thereon, then externally to surface 64 on first magnetic flux conductor 51 and then internally through the first magnetic flux conductor back to surface 63 thereon.

First and third magnetic flux conductors 51 and 59 and their associated coils 80 and 81 cooperate to develop, at relatively wide air gap 53, a horizontal magnetic field for confining the molten metal pool at its top part 41 (e.g., at a depth about 25% from the pool's top surface) when the pool is at its maximum height.

In operation, the time-varying current flowing through coil 80 is adjusted to obtain confinement of the pool's bottom part 42, and the time-varying current flowing through coil 81 is adjusted to obtain confinement of the pool's top part 41. Current flows through coils 80, 81 can be further adjusted (fine-tuned) to optimize the confinement field developed at relatively wide air gap 53 adjacent the pool's top part 41.

In some embodiments of dam 50, the currents flowing through coils 80, 81 can be in phase; in other embodiments, the current flowing through one of these coils (e.g. coil 80) can be phase shifted with respect to the current flowing through the other coil (e.g. coil 81).

Figure 21:
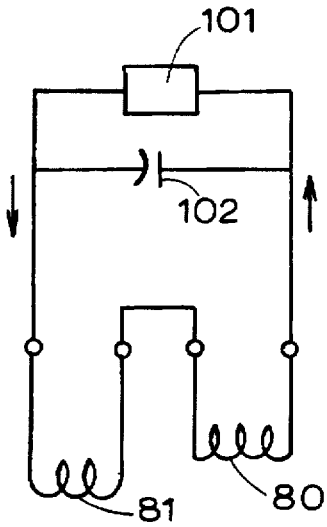
FIG. 21 is a diagram of an electrical circuit for use with the embodiment of FIGS. 4–5.
Figure 22:
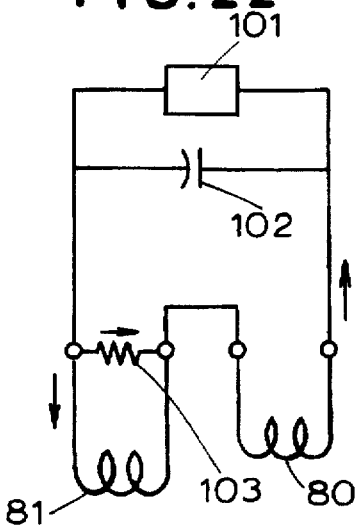
FIG. 22 is a diagram of another electrical circuit for use with the embodiment of FIGS. 4–5.

Diagrams of examples of circuits for producing the in-phase and phase-shifted conditions are depicted in FIGS. 21 and 22, respectively. Current flow is in the direction of the arrows in FIGS. 21 and 22. In FIG. 21, coils 80 and 81 are connected in series across an audio frequency power supply 101, and a capacitor assembly 102 is connected in parallel with the series of coils 80, 81. In the circuit of FIG. 21, the current in coil 80 is in phase with the current in coil 81. In FIG. 22, there is a resistor 103 in parallel with coil 81, and the current in coil 80 is phase-shifted with respect to the current in coil 81. The phase shift can be adjusted by changing the resistance at 103.

In the embodiments of dam 50 having the circuitry depicted in FIGS. 21 and 22, current for coils 80 and 81 is obtained from the same power supply 101. In other embodiments of dam 50, each coil 80, 81 can be provided with current from a different respective power supply.

Current adjusting and phase shifting can be employed to vary the topography of the magnetic field. The magnetic field topography relevant here is the intensity distribution of the magnetic field strength (B), between the dam (e.g., 50) and molten metal pool 38, in a direction along the width of pool 38.

The third magnetic flux conductor and its associated coil (or coil portion) help shape the topography of the magnetic field at the pool's upper part 41 (i.e. at wide air gap 53).

The molten metal confinement obtained with dam 50 is accomplished without employing any functional mechanical expedient for confining molten metal pool 38 at open end 36 of the space between casting rolls 31, 32.

Second magnetic flux conductor 55 provides a low reluctance return path for the horizontal magnetic field developed at narrow air gap 57. First and third magnetic flux conductors 51, 59, provide low reluctance return paths for the horizontal magnetic field developed across wide air gap 53.

Except for the surfaces facing in the direction of the molten metal pool, each of the magnetic flux conductors 51, 55 and 59 is substantially enclosed by non-magnetic, electrically conductive material. More particularly, referring again to FIGS . 4–5, third magnetic flux conductor 59 is substantially enclosed, at its inner and outer surfaces, within non-magnetic, electrically conductive material or shielding 93 separated from the surfaces of third magnetic flux conductor 59 by thin films of electrical insulation (not shown).

First and second magnetic flux conductors 51 and 55 are similarly enclosed in non-magnetic, electrically conductive shielding 94, separated from the surfaces of the magnetic flux conductors by thin films of electrical insulation (not shown). As discussed more fully below, there is at least one air gap between each shield 93, 94 and its respective magnetic flux conductor(s), to prevent the shield from acting like a shorted turn for the flux in the magnetic flux conductor.

Disposed between arms 71, 72 of third magnetic flux conductor 59 is a non-magnetic, electrical conductor element 84. Disposed between (a) arms 61, 62 of first magnetic flux conductor 51 and (b) arms 71, 72 of third magnetic flux conductor 59 is the bifurcated upper part 91 of a non-magnetic, electrical conductor element 85 having a lower part 92 disposed between arms 66, 67 of second magnetic flux conductor 55 (FIG. 4). Conductor element 84 has a rectangular horizontal cross section; it has a substantially downwardly tapering front surface 79 facing molten metal pool 38 (FIG. 4); and it is located between arms 71, 72 of third magnetic flux conductor 59. Each arm of bifurcated upper part 91 of conductor element 85 has a rectangular, horizontal cross-section. Lower part 92 of conductor element 85 has a rectangular, horizontal cross-section and a downwardly, arcuately tapering front surface 90 facing lower part 42 of molten metal pool 38. Conductor elements 84 and 85 are hollow and may be liquid cooled in a conventional manner.

Except for the surfaces which face in the direction of molten metal pool 38, and except as otherwise indicated, virtually all inner and outer surfaces of magnetic flux conductors 51, 55 and 59 are in substantially abutting relation with a surface of a non-magnetic, electrical conductor, with only a thin film of electrical insulation (not shown) interposed between the otherwise-abutting surfaces of non-magnetic, conductive shields 93 or 94 and a magnetic flux conductor 51, 55 or 59.

As shown in FIG. 5, there is an air space 98, having a rectangular, horizontal cross-section, between conductor element 84 and yoke 75 of third magnetic flux conductor 59. There is an air space 99, having a U-shaped, horizontal cross-section, between third magnetic flux conductor 59 and first magnetic flux conductor 51, behind upper part 91 of conductor element 85. There is an air space (not shown), having a rectangular, horizontal cross-section, between lower part 90 of conductor element 85 and second magnetic flux conductor 55.

Referring to FIG. 4, shield 93 has a top part 87 overlying and covering arms 71, 72 and yoke 75 on third magnetic flux conductor 59. There is an air gap 104 between top part 87 and the top surface of third magnetic flux conductor 59. Shield 94 has a top part 88 spaced above, overlying and covering arms 61, 62 and yoke 65 on first magnetic flux conductor 51. There is an air gap 105 between top part 88 and the top surface of first magnetic flux conductor 51. Shield 94 also comprises a bottom part 89 underlying arms 66, 67 and the yoke of second magnetic flux conductor 55. An air gap (not shown) may be provided between bottom part 89 and the bottom surface of second magnetic flux conductor 55. Shield 94 further comprises front plate parts 86 (FIG. 4) located to the left and right respectively (in FIG. 4) of the spaced-apart surfaces 63/68 and 64/69 on the first and second magnetic flux conductors 51, 55. Appropriate insulating films (not shown) are provided, where required, to prevent electrical connections or shorting between the magnetic flux conductors and the parts of shields 93, 94 described above in this paragraph.

As noted above, first, second and third magnetic flux conductors 51, 55 and 59 provide low reluctance return paths for the horizontal magnetic fields developed by dam 50. Non-magnetic, electrically conductive shields 93, 94 and elements 84 and 85 confine that part of a magnetic field which is outside of its low reluctance return path to substantially the air gap at which the field is developed.

In the embodiment of FIG. 5, spaced-apart surfaces 73, 74 on third magnetic flux conductor 59, front surface 79 on conductor element 84, and spaced apart surfaces 63, 64 on first magnetic flux conductor 51, all lie in the same vertical plane. In a variation of that embodiment, shown in FIG. 5*a*, third magnetic flux conductor 59 has rearwardly converging spaced-apart surfaces 73*a*, 74*a*, and conductor element 84 has a rearwardly recessed front surface 79*a*.

In all embodiments of the present invention, the magnetic flux conductors are composed of material conventionally utilized for such purposes (e.g. (a) laminations of silicon electrical steel having compositions conventionally employed for electromagnetic purposes or (b) high temperature ferrite).

Figure 6:
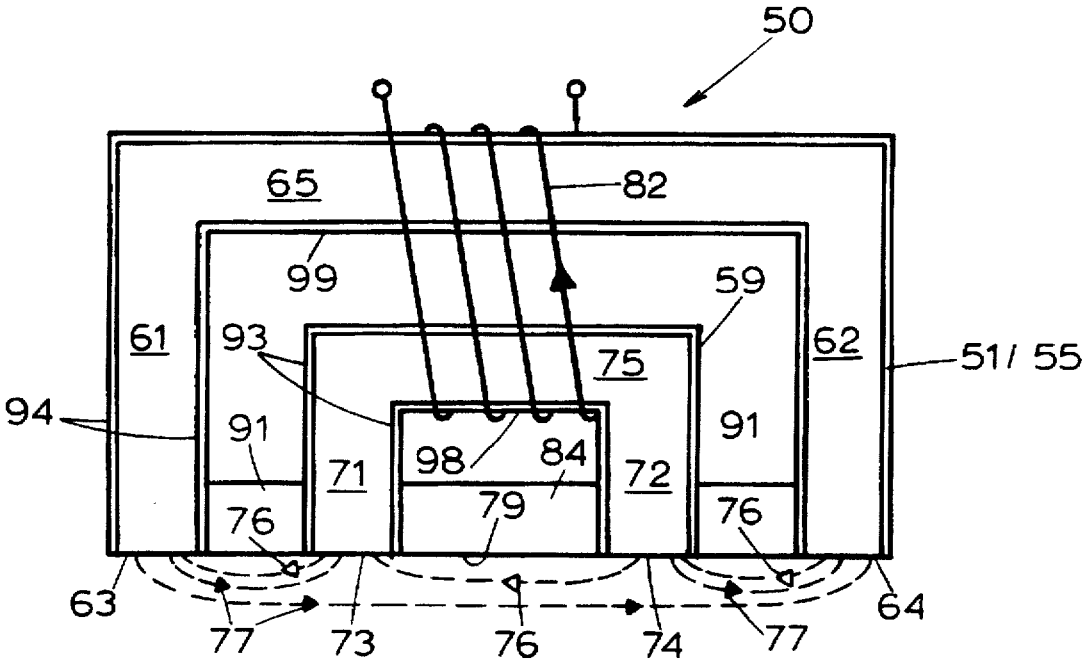
FIG. 6 is a plan view, similar to FIG. 5, of a variation of the embodiment of FIG. 5, employing a single coil.

In the embodiment of FIGS. 4–5, first and second magnetic flux conductors 51, 55 are physically associated with one coil 80, and third magnetic flux conductor 59 is physically associated with another coil 81. Alternatively, one may employ a single coil 82 (FIG. 6) wrapped around both yoke 75 of third magnetic flux conductor 59 and yoke 65 of first and second magnetic flux conductors 51, 55. The embodiment of FIG. 6 is otherwise essentially identical in structure to the embodiment of FIGS. 4–5. In operation, current flow through coil 82 is adjusted to obtain confinement at the upper and lower parts 41, 42 of molten metal pool 38. As there is only one coil, phase shifting and other adjustments, available with the two-coil arrangement of FIGS. 4–5, are not available with the single coil arrangement of FIG. 6.

The flux lines developed by first and third magnetic flux conductors 51, 59, in the embodiment of FIG. 6, are shown at 76, 77 respectively.

Flux 76 flows externally from surface 73 on third magnetic flux conductor 59 to surface 74 thereon and then internally through the third magnetic flux conductor back to surface 73. Flux 76 also flows externally from surface 73 to surface 63 on first magnetic flux conductor 51, then internally through the first magnetic flux conductor to surface 64 thereon, then externally to surface 74 on third magnetic flux conductor 59 and then internally through the third magnetic flux conductor to surface 73 thereon.

Flux 77 flows externally from surface 63 on first magnetic flux conductor 51 to surface 64 thereon and then internally through the first magnetic flux conductor back to surface 63 thereon. Flux 77 also flows externally from surface 63 to surface 73 on third magnetic flux conductor 59, then internally through the third magnetic flux conductor to surface 74 thereon, then externally to surface 64 on first magnetic flux conductor 51 and then internally through the first magnetic flux conductor back to surface 63 thereon.

Figure 8:
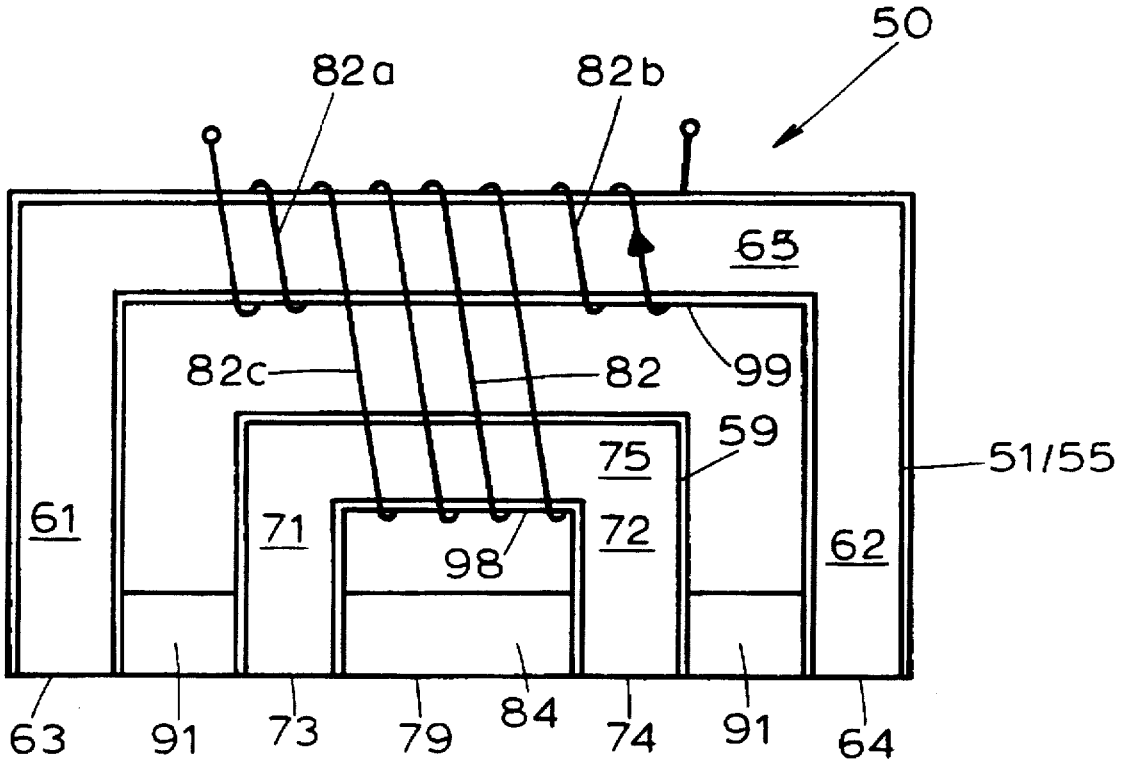
FIG. 8 is a plan view, similar to FIG. 6, showing another way of employing a single coil.

Referring now to FIG. 8, illustrates therein is a variation of the single coil arrangement of FIG. 6. In the embodiment of FIG. 8, coil 82 has a pair of outer coil parts 82*a*, 82*b*, associated only with first and second magnetic flux conductors 51, 55, and a middle coil part 82*c* associated with third magnetic flux conductor 59. Aside from differences in coil 82, the embodiments of FIGS. 6 and 8 are essentially identical in structure; and the operation of both embodiments is essentially the same.

Figure 7:
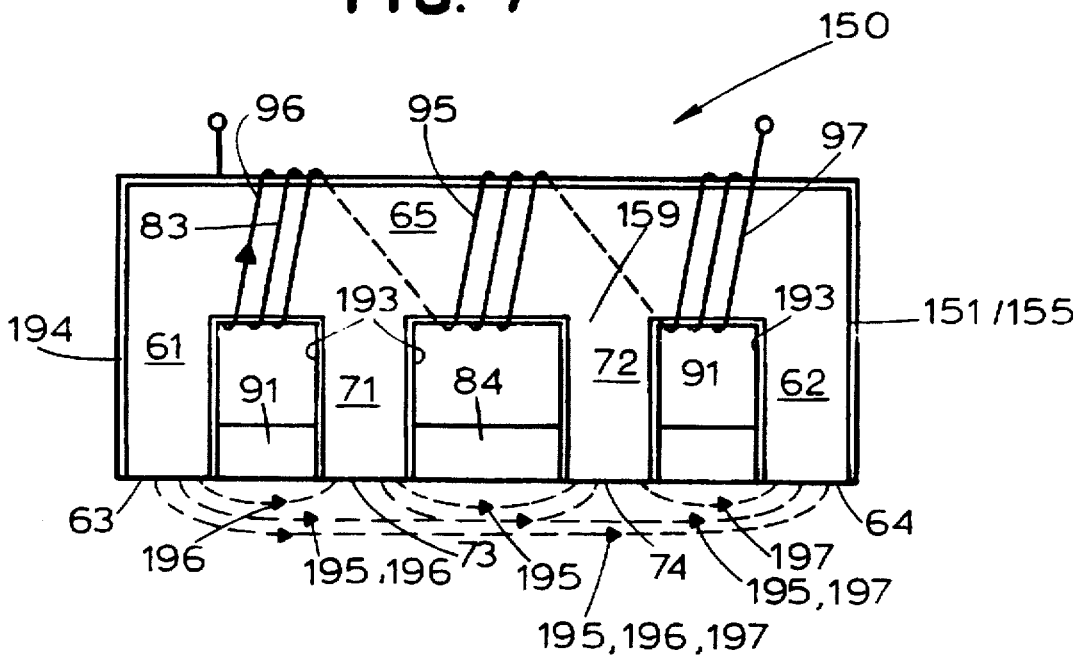
FIG. 7 is a plan view of another embodiment of an electromagnetic confining dam, with a top cover removed, and showing a single coil which would be relatively remote from a pool of molten metal.

Another embodiment of an electromagnetic confining dam is indicated generally at 150 in FIG. 7. In this embodiment, the yoke on the third magnetic flux conductor 159 is integral with and a part of yoke 65 on a first magnetic flux conductor 151 having a pair of arms 61, 62 extending from yoke 65 and terminating at spaced-apart surfaces 63, 64 respectively. Located between arms 61, 62 are a pair of arms 71, 72 of the third magnetic flux conductor. Arms 71, 72 extend from yoke 65 and terminate at spaced-apart surfaces 73.

The second magnetic flux conductor 155 in dam 150 has a pair of spaced-apart arms and a yoke which comprise downward extensions of arms 61, 62 and yoke 65 of first magnetic flux conductor 151. As in the embodiments of FIGS. 4–6 and 8, arms 71, 72 on the third magnetic flux conductor terminate downwardly at a location substantially above the downward termination of the arms on the second magnetic flux conductor.

Disposed between arms 71, 72 of third magnetic flux conductor 159 is a non-magnetic, electrical conductor element 84. Disposed between (a) arms 61, 62 of first magnetic flux conductor 151 and (b) arms 71, 72 of third magnetic flux conductor 159 is the bifurcated upper part 91 of a non-magnetic, electrical conductor element 85 having a lower part disposed between arms 66, 67 of second magnetic flux conductor 55. In the embodiment of FIG. 7, conductor element 85 is essentially identical in structure to conductor element 85 in the embodiments of FIGS. 4–6 and 8.

The inner and outer surfaces of yoke 65, arms 61, 62 and arms 71, 72 on the magnetic flux conductors of dam 150 are enclosed by non-magnetic, electrically conductive shielding 193, 194 separated from the surfaces of the magnetic flux conductors by thin films of electrical insulation (not shown). Electrical conductor elements 84, 85 and shields 193, 194 in dam 150 of FIG. 7 perform the same functions as conductor elements 84, 85 and shields 93, 94 in dam 50 in FIGS. 4–6 and 8. There are appropriate air gaps between shields 193, 194 and the magnetic flux conductors. These air gaps are similar in construction and function to the air gaps between shields 93, 94 and the associated magnetic flux conductor in the embodiment of FIGS. 4–6 and 8, as discussed above.

All of the surfaces on the three magnetic flux conductors in dam 150 are substantially enclosed by non-magnetic electrically conductive material except for spaced-apart surfaces 63, 64 on first and second magnetic flux conductors 151, 155 and spaced-apart, pool-facing, surfaces 73, 74 on third magnetic flux conductor 159.

Dam 150 employs a single coil 83 associated with all of the magnetic flux conductors of dam 150. Coil 83 has a central winding 95 and a pair of outer windings 96, 97 each encircling yoke 65 of the magnetic flux conductors. The flux lines developed by the core windings 95, 96, 97 are shown in FIG. 7 at 195, 196 and 197, respectively.

Flux flow at dam 150 is both external, between surfaces of magnetic flux conductor 151/155, and internal, through arms 61, 62, 71, 72 and yoke 65 of magnetic flux conductor 151/155. Flux 196 flows externally from surface 63 to each of surfaces 73, 74 and 64 and then flows internally back to surface 63; flux 195 flows externally from surfaces 63 and 73 to each of surfaces 74 and 64 and then flows internally to surfaces 63 and 73; flux 197 flows externally from each of surfaces 63, 73, 74 to surface 64 and then flows internally to surfaces 63, 73, 74.

Figure 17:
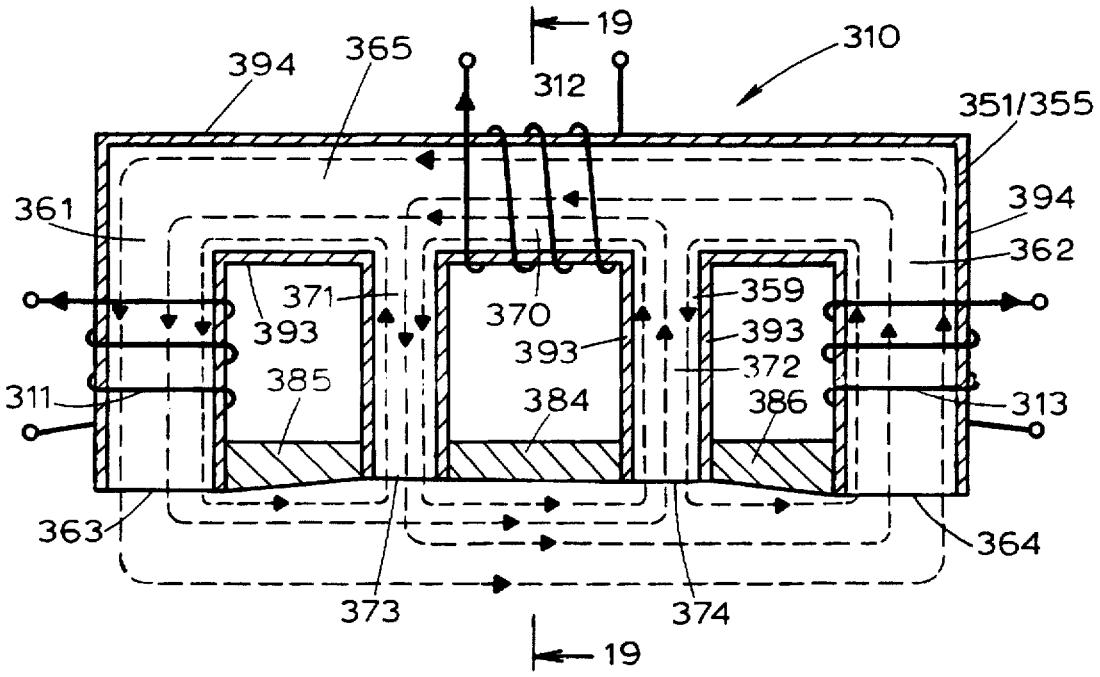
FIG. 17 is a plan view of an embodiment of an electromagnetic confining dam, with a top cover removed, and showing three coils which would be relatively remote from a pool of molten metal.
Figure 19:
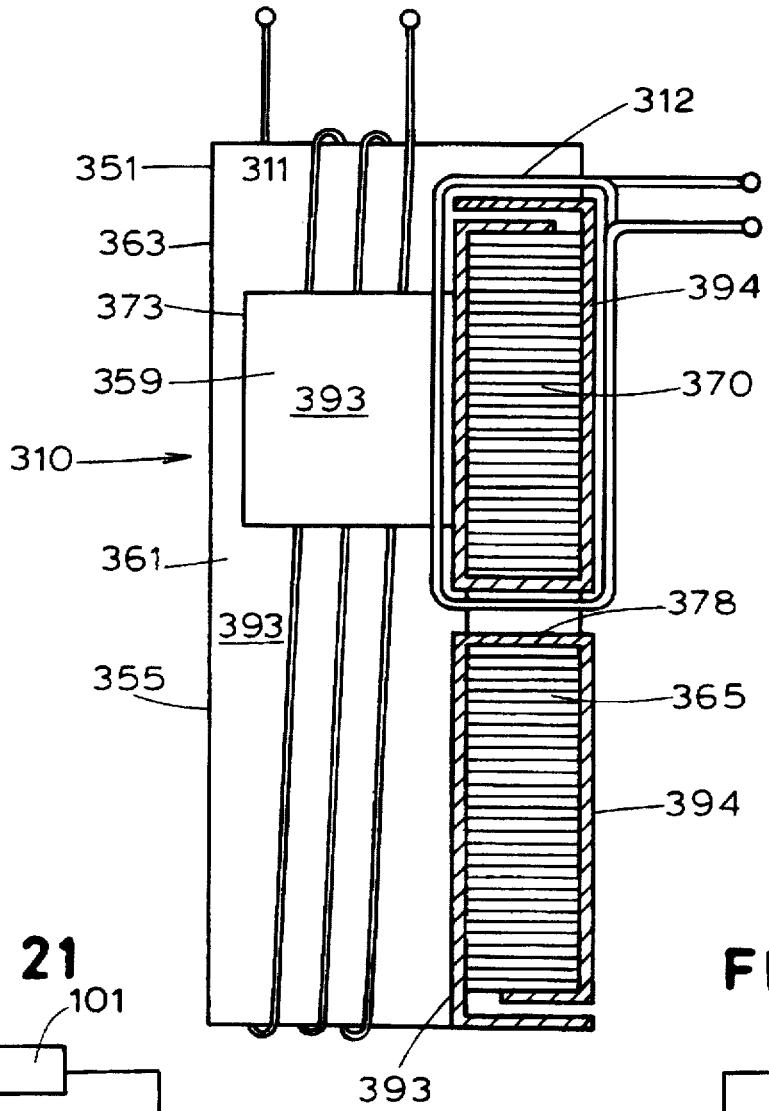
FIG. 19 is a sectional view taken along line 19—19 in FIG. 17.

Referring now to FIGS. 17–19, illustrated therein is an embodiment of a dam 310 similar in some respects to dam 150 of FIG. 7 but differing principally in the employment of three coils instead of the single coil of dam 150. There are two outer coils 311, 313 physically associated with first and second magnetic flux conductors 351, 355 and a middle coil 312 physically associated with a third magnetic flux conductor 359. First magnetic flux conductor 351 comprises a pair of arms 361, 362 extending from a yoke 365 and terminating at spaced-apart surfaces 363, 364, respectively. Second magnetic flux conductor 355 has a pair of arms and a yoke which are downward extensions of the arms 361, 362 and yoke 365 of first magnetic flux conductor 351. Outer coil 311 is wrapped around arm 361, and outer coil 313 is wrapped around arm 362.

Third magnetic flux conductor 355 has a pair of arms 371, 372 extending from the upper part 370 of yoke 365 and terminating at spaced-apart surfaces 373, 374 facing molten metal pool 38. Middle coil 312 is wrapped around upper yoke part 370 and extends through a slot 378 in yoke 365 (FIG. 19). Non-magnetic conductor elements 385, 384, 386 are disposed between arms 361, 371, 372, 362 of the magnetic flux conductors (FIG. 17). Non-magnetic, metal shieldings 393,394 encase the surfaces of the legs and yoke of the magnetic flux conductors, as in other embodiments discussed above. Thin films of insulation (not shown) are interposed between the shieldings and the adjacent surfaces of the magnetic flux conductors to prevent electrical shorting.

Referring to FIG. 18, a non-magnetic, metal plate 391 (e.g., a copper plate) covers the front of dam 310, except for spaced-apart surfaces 363, 364 and 373, 374 on the arms of the magnetic flux conductors. Plate 391 extends above and below the magnetic flux conductors to help shape the magnetic field. Extending downwardly from the top of plate 391 are slits 399 for preventing eddy currents from flowing in plate 391 due to flux in third magnetic flux conductor 359.

The magnetic flux lines generated by dam 310 are shown by dashed lines and arrows in FIG. 17. Magnetic flux flows externally from surface 363 to surfaces 373, 374 and 364; magnetic flux also flows externally from surface 373 to surfaces 374 and 364 and from surface 374 to surface 364. Magnetic flux flows internally from surface 364 to surfaces 363, 373 and 374; magnetic flux also flows internally from surface 374 to surfaces 363 and 373 and from surface 373 to surface 363.

Referring now to FIG. 12–16, illustrated therein is an embodiment of an electromagnetic confining dam 110 employing a coil which is relatively proximate to the pool of molten metal. In this embodiment, there is one coil portion having a front surface which (a) faces open end 36 of space 35 between casting rolls 31, 32 (FIG. 3) and (b) is sufficiently proximate to open end 36 to enable the direct generation of a horizontal magnetic field which extends through open end 36 to molten metal pool 38.

Dam 110 comprises first, second and third magnetic flux conductors 111, 112 and 113 respectively, each conforming structurally to the first, second and third magnetic flux conductors in the embodiments of FIGS. 4–6 and 8.

First magnetic flux conductor 111 comprises a pair of spaced-apart arms 115, 116 extending from a yoke 119 and each terminating at a respective one of a pair of spaced-apart end surfaces 117, 118 facing in the direction of pool 38 and disposed directly opposite rim portions 44 and 43 respectively on casting rolls 32 and 31 (FIG. 2). Second magnetic flux conductor 112 has a yoke, a pair of arms and a pair of spaced-apart end surfaces which are downward extensions of the arms, the yoke and the spaced-apart end surfaces on first magnetic flux conductor 111. Third magnetic flux conductor 113 comprises a pair of spaced-apart arms 121, 122 extending from a yoke 125 and each terminating at a respective one of a pair of spaced-apart, pool-facing end surfaces 123,124. Spaced-apart surfaces 117, 118 on first magnetic flux conductor 111 are opposite casting roll rim portions 44, 43 respectively (FIG. 2) and are adjacent top part 41 of molten metal pool 38 (FIG. 2); also adjacent the pool's top part are spaced-apart surfaces 123, 124 of third magnetic flux conductor 113. The spaced-apart end surfaces on second magnetic flux conductor 112 are disposed opposite rim portions 43, 44 and are adjacent bottom part 42 of molten metal pool 38 (FIG. 2).

The end surfaces of second magnetic flux conductor 112 are downward extensions of terminal surfaces 117, 118 on first magnetic flux conductor 111. Yoke 125 and arms 121, 122 on third magnetic flux conductor 113 are separate and discrete from the yoke and the arms on the first and second magnetic flux conductors 111, 112. Yoke 125 and arms 121, 122 on third magnetic flux conductor 113 terminate downward at a location substantially above the downward termination of the arms and the yoke on second magnetic flux conductor 112.

Dam 110 comprises a first coil portion 126 located in front of yoke 125 on third magnetic flux conductor 113 and between arms 121, 122 of third magnetic flux conductor 113. First coil portion 126 has a hollow, substantially rectangular horizontal cross-section and is substantially vertically co-extensive with first and second magnetic flux conductors 111, 112. First coil portion 126 has a front surface 127 which (a) faces open end 36 of space 35 between casting rolls 31, 32 (FIG. 3) and (b) is sufficiently proximate to open end 36 that, when current flows through first coil portion 126, there is directly generated a horizontal magnetic field which extends through open end 36 to molten metal pool 38 (FIG. 2). Front surface 127 has an upper part 143 which tapers arcuately downwardly between spaced-apart, pool-facing surfaces 123, 124 on third magnetic flux conductor 113.

Figure 13:
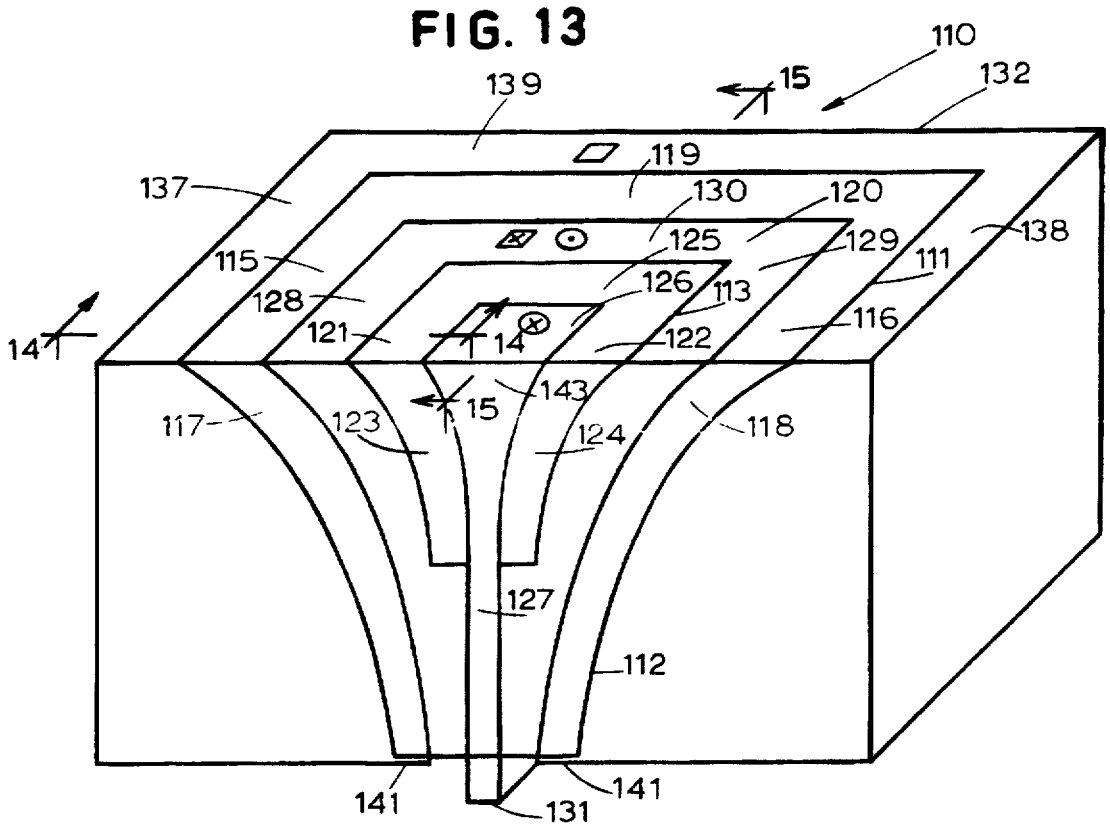
FIG. 13 is a perspective of the FIG. 12 embodiment.

Electrically connected to first coil portion 126 is a hollow, second coil portion 120 having a yoke 130 from which extend a pair of spaced-apart arms 128, 129. Yoke 130 is located between yoke 125 of third magnetic flux conductor 113 and yoke 119 of first and second magnetic flux conductors 111, 112. Arm 128 on second coil portion 120 is located between arm 121 on third magnetic flux conductor 113 and arm 115 on first and second magnetic flux conductors 111, 112. Arm 129 on second coil portion 120 is located between arm 122 on third magnetic flux conductor 113 and arm 116 on first and second magnetic flux conductors 111, 112. Arms 128, 129 and yoke 130 on second coil portion 120 are vertically co-extensive with the arms and the yoke on the first and second magnetic flux conductors 111, 112. First coil portion 126 is disposed between spaced-apart arms 121, 122 of third magnetic flux conductor 113 and is vertically co-extensive with arms 128, 129 and yoke 130 of second coil portion 120. The first and second coil portions 126, 130 are connected by a shorting element 131 which extends between first coil portion 126 and yoke 130 of the second coil portion at the bottom extremity of each (FIGS. 13 and 15).

There are thin films of electrical insulation (not shown) between adjacent surfaces of first coil portion 126 and the lower part of arms 128, 129 of second coil portion 120. The films of electrical insulation prevent shorting between the first and second coil portions. The only electrical connection between the two coil portions is shorting element 131, as previously described.

A third coil portion 132, having a pair of arms 137, 138 connected by a yoke 139, is located exteriorly of first and second magnetic flux conductors 111, 112 and is substantially vertically coextensive with them. Third coil portion 132 is electrically connected to second coil portion 120 by a shorting element 136 extending between the bottom of yoke 130 on second coil portion 120 and the bottom of yoke 139 on third coil portion 132 (FIG. 15).

Figure 12:
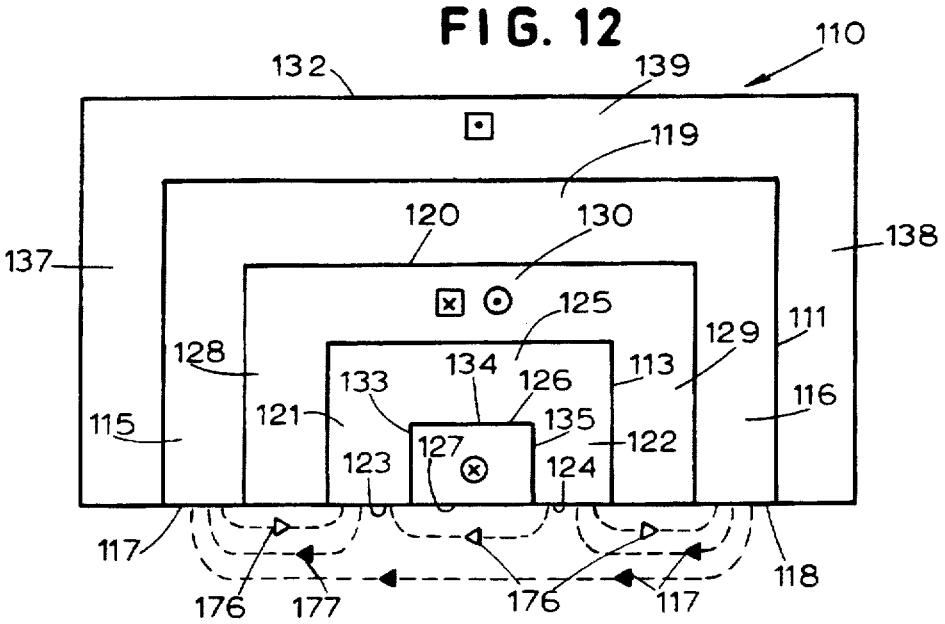
FIG. 12 is a plan view of another embodiment of electromagnetic confining dam in accordance with the present invention, with a top cover removed and having a coil portion which would be relatively proximate to a pool of molten metal.
Figure 16:
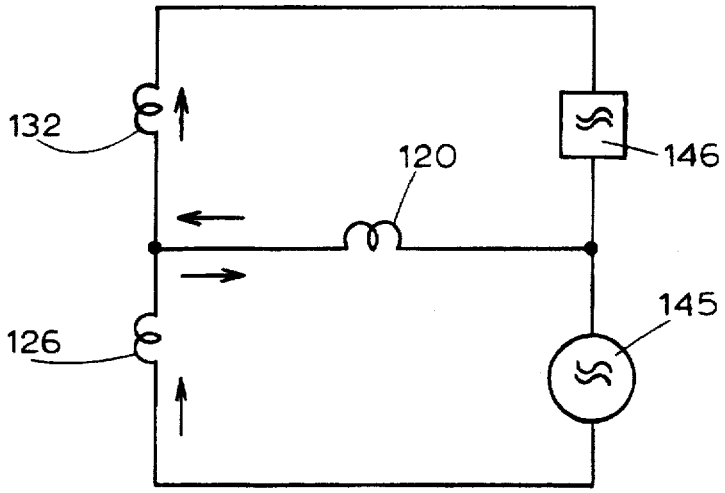
FIG. 16 is a circuit diagram for the embodiment of FIGS. 12–15.

Referring now to FIGS. 12 and 16, in a typical operation, current from a current source 145 (FIG. 16) flows downwardly through first coil portion 126, through shorting element 131 (FIG. 15) to second coil portion 120, then upwardly through second coil portion 120 and back to current source 145. Current from another source 146 flows downwardly through second coil portion 120, through shorting element 136 (FIG. 15) to third coil portion 132, then upwardly through third coil portion 132 and back to current source 146.

The current flowing through first and second coil portions 126 and 120 (from current source 145) directly generates a magnetic field, comprising magnetic flux, at open end 36 of space 35 between the casting rolls. The current flowing through second and third coil portions 120 and 132 (from current source 146) cooperate with the first and second magnetic flux conductors 111, 112 to develop, at open end 36, additional magnetic flux. The three magnetic flux conductors 111, 112, 113 provide a low reluctance return path for the magnetic flux described in the preceding part of this paragraph. The flux lines developed by first and second coil portions 126, 120 (in association with third magnetic flux conductor 113) are shown at 176 in FIG. 12, and the flux lines developed by second and third coil portions 120, 132 (in association with first and second magnetic flux conductors 111, 112) are shown at 177 in FIG. 12.

Flux 176 flows externally from surface 124 on third magnetic flux conductor 113 to surface 123 thereon and then internally through the third magnetic flux conductor back to surface 124; flux 176 also flows externally from surface 124 to surface 118 on first magnetic flux conductor 111, then internally through the first magnetic flux conductor to surface 117 thereon, then externally to surface 123 on third magnetic flux 113 and from there internally through the third magnetic flux conductor back to surface 124.

Flux 177 flows externally from surface 118 on first magnetic flux conductor 111 to surface 117 thereon and then internally through the first magnetic flux conductor back to surface 118. Flux 177 also flows externally from surface 118 to surface 124 on third magnetic flux conductor 113, then internally through the third magnetic flux conductor to surface 123 thereon, then externally to surface 117 on first magnetic flux conductor 111 and the internally through the first magnetic flux conductor back to surface 118 thereon. Current sources 145 and 146 (FIG. 16) are connected to their respective coil portions 126, 120 and 132 with electrical connections of conventional construction.

As shown in FIG. 12, first coil portion 126 has surfaces 133, 134 and 135 in addition to its front surface 127. Third magnetic flux conductor 113 encloses surfaces 133, 134 and 135 at the wide upper part of dam 110 and substantially diminishes time-varying electric current which flows along a surface of coil portion 126 other than its front surface 127 at the wide upper part of the dam, thereby concentrating the current at front surface 127.

Coil portions 126, 120 and 132 are electrically insulated from the magnetic flux conductors 111, 112, 113 by thin films of electrical insulation (not shown) between adjacent surfaces of the coil portions and the magnetic flux conductors.

Typically, the coil portions are composed of copper, they are hollow, and they contain provision (not shown) for circulating a cooling liquid through the hollow interiors of the coil portions.

As shown in FIG. 13, third magnetic flux conductor 113 is substantially sandwiched between first coil portion 126 and arms 128, 129 and yoke 130 of second coil portion 120 which, as noted above, are all composed of non-magnetic, electrically conductive material (e.g. copper). First magnetic flux conductor 111, and its downward extension constituting second magnetic flux conductor 112, are substantially sandwiched between second coil portion 120 and arms 137, 138 and yoke 139 of third coil portion 132 which also is composed of non-magnetic, electrically conductive material. Substantially the only parts of the magnetic flux conductors which are not enclosed by non-magnetic, electrically conductive material are (i) spaced-apart, surfaces 117, 118 on first magnetic flux conductor 111 (and its downward extension constituting second magnetic flux conductor 112), and (ii) spaced-apart, pool-facing surfaces 123, 124 on third magnetic flux conductor 113. As previously noted, the three magnetic flux conductors provide a low reluctance return path for the magnetic field generated by the coil arrangement. The non-magnetic, electrically conductive elements, namely coil portions 126, 120 and 132, act to confine that part of the magnetic field which is outside of its low reluctance return path to substantially open end 36 of space 35 between the two casting rolls (FIG. 3).

Referring now to FIGS. 14–15, third coil portion 132 comprises a top cover part 140 overlying and spaced above arms 115 and 116 and yoke 119 on first magnetic flux conductor 111. A bottom part 141 on third coil portion 132 underlies the arms and yoke on first magnetic flux conductor 111 and is separated therefrom by a thin film of electrical insulation (not shown). A top cover part 142 on second coil portion 120 overlies and is spaced above arms 121, 122 and yoke 125 of third magnetic flux conductor 113. Parts 140, 141 and 142 of coil portions 132 and 120 help confine that part of the magnetic field generated by the coil arrangement, and which is outside of the low reluctance return path defined by magnetic flux conductors 111, 112 and 113, to substantially open end 36 of space 35 between casting rolls 31, 32 (FIG. 3).

Figure 9:
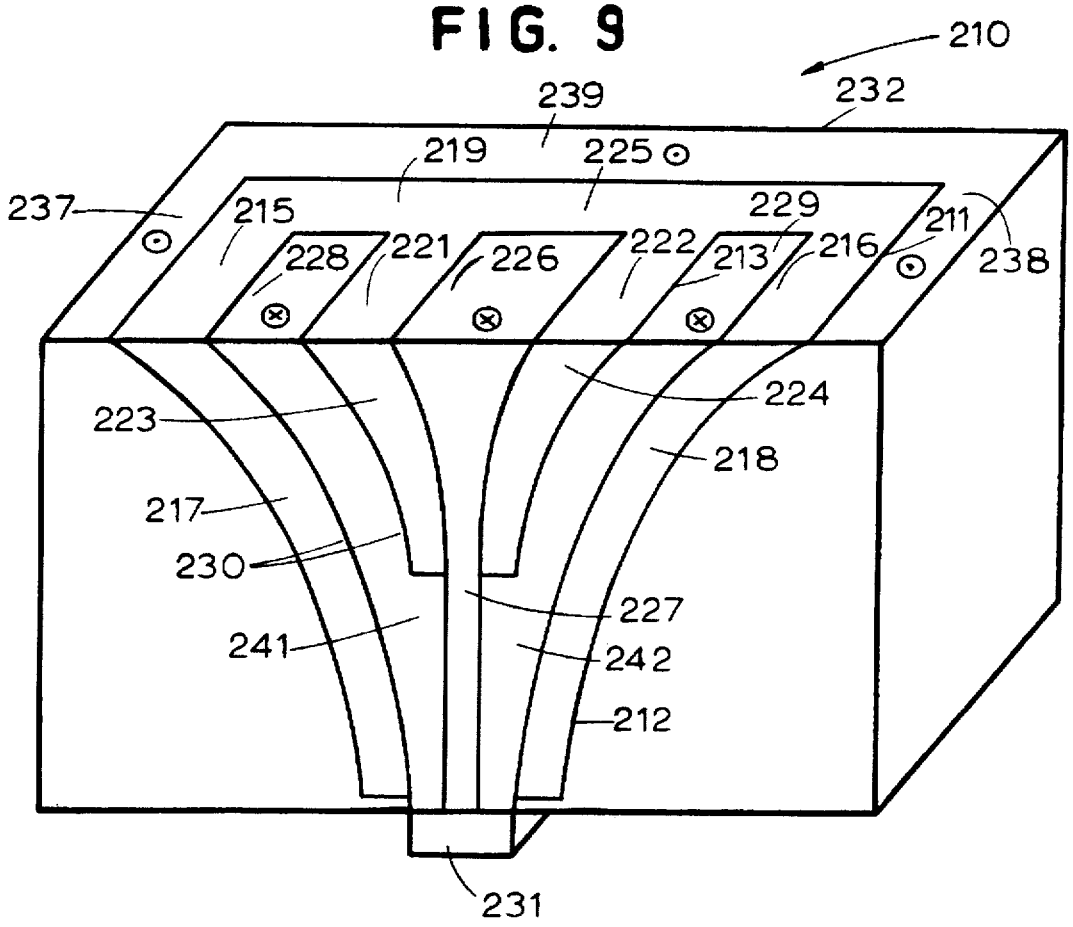
FIG. 9 is a perspective of another embodiment of an electromagnetic confining dam in accordance with the present invention, with a top cover removed, and having a coil portion which would be relatively proximate to a pool of molten metal.
Figure 10:
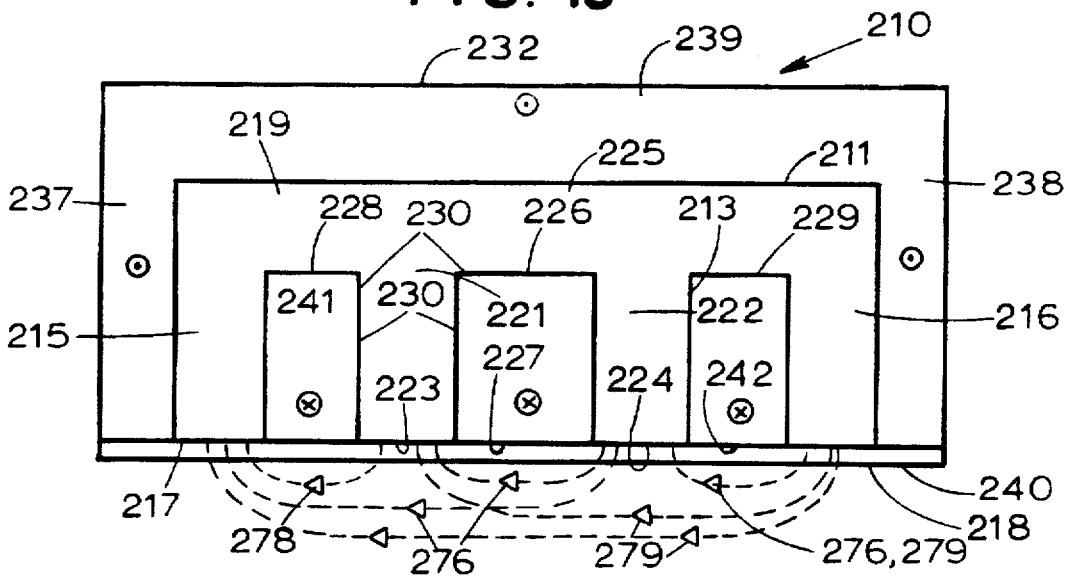
FIG. 10 is a plan view of the embodiment of FIG. 9.

Referring now to FIGS. 9–11, illustrated therein is an embodiment of a dam indicated generally at 210 and constructed in accordance with the present invention. Dam 210 comprises first and second magnetic flux conductors 211, 212 respectively. First magnetic flux conductor 211 comprises a pair of arms 215, 216 extending from a yoke 219 and terminating at a pair of spaced-document apart, end surfaces 217, 218, respectively, each facing in the direction of pool 38. The arms and the yoke on second magnetic flux conductor 212 are integral with the arms and the yoke respectively on first magnetic flux conductor 211 and comprise downward extensions of the arms and yoke on the first magnetic flux conductor.

A third magnetic flux conductor 213 comprises a pair of spaced-apart arms 221, 222 extending from a yoke 225 and terminating at a pair of spaced-apart, pool-facing end surfaces 223, 224 respectively. Yoke 225 of third magnetic flux conductor 213 is integral with and a part of yoke 219 of first magnetic flux conductor 211. Arms 221, 222 of the third magnetic flux conductor terminate downwardly at a location substantially above the downward termination of the arms on second magnetic flux conductor 212.

Dam 210 comprises a first coil portion 230 located in front of integral yokes 225 and 219 of the magnetic flux conductors and substantially vertically co-extensive with first and second magnetic flux conductors 211, 212. First coil portion 230 is composed of a middle part 226 having a front surface 227 and a pair of outer parts 228, 229 having respective front surfaces 241, 242. All of coil parts 226, 228 and 229 have hollow, substantially rectangular, horizontal cross-sections. The upper section of middle coil part 226 is located between spaced-apart arms 221, 222 of third magnetic flux conductor 213. The upper section of outer coil part 228 is located between arm 215 of first magnetic flux conductor 211 and arm 221 of third magnetic flux conductor 213. The upper section of outer coil part 229 is located between arm 216 of first magnetic flux conductor 211 and arm 222 of third magnetic flux conductor 213. Outer coil parts 228, 229 converge arcuately downwardly toward the lower section of middle coil part 226. The lower sections of coil parts 226, 228 and 229 are electrically insulated from each other by a thin film of electrical insulation (not shown).

As previously noted, coil parts 226, 228 and 229 have respective front surfaces 227, 241 and 242 which perform a function similar to the function performed by front surface 127 on first coil portion 126 of dam 110. When a time-varying electric current flows through coil parts 226, 228 and 229, front surfaces 227, 241 and 242 are sufficiently proximate to open end 36 of space 35 (FIG. 3) to enable a magnetic field directly generated by these coil parts to extend through open end 36 to molten metal pool 38 (FIG. 2). Magnetic flux conductors 211, 212 and 213 of dam 210 substantially diminish the time-varying electric current which flows along a surface of a respective coil part 226, 227 and 228, other than the coil part's front surface 227, 241 and 242, thereby concentrating the current at each front surface.

A second coil portion 232 is located exteriorly of first and second magnetic flux conductors 211, 212 and is substantially vertically co-extensive with them. Second coil portion 232 comprises a pair of arms 237, 238 extending from a yoke 239. Second coil portion 232 is electrically connected with each of coil parts 226, 228 and 229 of first coil portion 230, at the bottom extremity of each such coil part, by a shorting element 231 (FIGS. 9 and 11).

Typically, current from a current source (not shown) flows initially downwardly through parts 226, 228, 229 of first coil portion 230, then through shorting element 231, then upwardly through second coil portion 232 and then back to the current source through conventional electrical connections and conductors (not shown).

In the embodiment illustrated in FIGS. 9–11, shorting element 231 connects all three coil part 226, 227 and 228 of the first coil portion to second coil portion 232. In a variation of the illustrated embodiment, one may employ three separate shorting elements each connecting a respective coil part 226, 228, 229, of first coil portion 230, to second coil portion 232.

In all variations of electromagnetic confining dam 210, parts 226, 228 and 229 of first coil portion 226, and second coil portion 232, all function to confine that part of a magnetic field which is outside of its low reluctance return path to substantially open end 36 of space 35 between casting rolls 31, 32 (FIG. 3). As previously noted, the low reluctance return path is defined by arms 215, 216 and yoke 219 of the first and second magnetic flux conductors 211, 212 and by arms 221, 222 of the third magnetic flux conductor.

The flux lines developed by coil parts 226, 228 and 229 are shown in FIG. 10 at 276, 278 and 279 respectively. Flux 278 developed by coil part 228 flows externally from surface 223 on third magnetic flux conductor 213 to surface 217 on first magnetic flux conductor 211 and then internally through arm 215 and yoke 219 on the first magnetic flux conductor and arm 221 on the third magnetic flux conductor back to surface 223. Flux 276 developed by coil part 226 flows externally from surface 224 to surface 223 on the third magnetic flux conductor and then internally through the third magnetic flux conductor back to surface 224; other flux 276 flows from surface 224 to surface 217 on the first magnetic flux conductor and then internally through arm 215, yokes 219 and 225 and arm 222 back to surface 224. Flux 279 from coil part 229 flows externally and internally as follows: external flow is from surface 218 on first magnetic flux conductor 211 to surfaces 223 and 224 on third magnetic flux conductor 213 and to surface 217 on first magnetic flux conductor 211; internal flow is from surfaces 223,224 and 217 through respective arms 221, 222 and 215 and through yokes 219 and 225 to arm 216 and then back to surface 218.

A refractory heat shield 240 (shown in FIGS. 10 and 11) is mounted on the front of dam 210 so as to be disposed between dam 210 and open end 36 of space 35 between casting rolls 31, 32 (FIG. 3). Heat shield 240 is typically about 2 mm thick and is spaced outwardly from open end 36 of space 35 and does not function as a mechanical dam. There is no contact between heat shield 240 and molten metal pool 38 during normal operation of the continuous strip caster. Heat shield 240 is provided as a precaution in case there is a power failure, or other malfunction in the system, which renders electromagnetic confining dam 210 inoperative. A refractory shield similar to shield 240 may be employed with each of the other embodiments of an electromagnetic confining dam in accordance with the present invention.

As shown partially in FIG. 11, coil parts 226, 228 and 229 and second coil portion 232 are hollow; they are all composed of a conductive material such as copper, and there is provision (not shown) for circulating a cooling liquid through their hollow interiors.

In the drawings, current flow in the remote coils, in FIGS. 5–8 and 17, is in the direction of the arrows on the coils; in the proximate coils, current flow is symbolized, in FIGS. 9–10 and 12–13, by an encircled dot for upward flow and by an encircled x for downward flow.

The foregoing detailed description has been given for clearness of understanding only, and no unnecessary limitations should be understood therefrom, as modifications will be obvious to those skilled in the art.

We claim:

1. In a twin roll strip casting apparatus comprising an electromagnetic dam for confining a vertically disposed pool of molten metal at the open end of a vertically extending space between two horizontally disposed, counter-rotating casting rolls in said apparatus, wherein said dam comprises;

three magnetic flux conductors each having a pair of spaced-apart surfaces adjacent to and facing in the direction of said pool of molten metal;

a first of said flux conductors having a first pair of said surfaces, said first pair of surfaces defining a relatively wide air gap adjacent a top part of said molten metal pool;

a second of said flux conductors having a second pair of said surfaces, said second pair of surfaces defining a relatively narrow air gap adjacent a bottom part of said pool;

a third of said flux conductors having a third pair of said surfaces, said third pair of surfaces being disposed between said two surfaces of said first flux conductor, in said wide air gap;

and coil means, associated with each of said magnetic flux conductors, for developing horizontal magnetic fields at said open end to confine said pool of molten metal.

2. An electromagnetic dam as recited in claim 1 wherein:

said first magnetic flux conductor has a relatively wide upper part adjacent the top part of said pool, when the latter is at its maximum height;

said second magnetic flux conductor is located below said first magnetic flux conductor and has a relatively narrow part adjacent the bottom part of said pool at the nip between said rolls;

said coil means associated with said second magnetic flux conductor comprises means for providing a time-varying electric current to develop, at said relatively narrow air gap, a horizontal magnetic field for confining said pool at said nip when the pool is at its maximum height;

said coil means associated with said first magnetic flux conductor comprises means for providing a time-varying electric current to develop, at said relatively wide air gap, a horizontal magnetic field comprising magnetic flux;

and said coil means associated with said third magnetic flux conductor comprises means for providing a time-varying electric current to develop, at said relatively wide air gap, additional magnetic flux which augments at least part of the magnetic flux developed by said first magnetic flux conductor and its associated coil means;

said first and third magnetic flux conductors and the coil means associated therewith comprising means cooperating to develop, at said relatively wide air gap, a horizontal magnetic field for confining said pool at its top part when the pool is at its maximum height.

3. A dam as recited in claim 2 wherein:

each of said spaced-apart surfaces in said three pairs of surfaces is substantially unenclosed by non-magnetic, electrically conductive means.

4. A dam as recited in claim 3 wherein:

said second magnetic flux conductor comprises means for providing a low reluctance return path for the horizontal magnetic field developed at said narrow air gap;

said first and third magnetic flux conductors comprise means for providing a low reluctance return path for the horizontal magnetic field developed at said wide air gap.

5. A dam as recited in claim 4 and comprising:

non-magnetic, electrically conductive means having portions thereof substantially enclosing each of said magnetic flux conductors, other than said pair of surfaces thereon facing in the direction of said pool;

said non-magnetic, electrically conductive means comprising means for confining that part of a magnetic field which is outside of its low reluctance return path to substantially said air gap at which the field is developed.

6. A dam as recited in claim 5 wherein:

each of said first and second magnetic flux conductors comprises a pair of spaced-apart arms each having a respective one of said pair of spaced-apart, unenclosed surfaces, and a yoke connecting said arms.

7. A dam as recited in claim 6 wherein:

the arms and the yoke on said second magnetic flux conductor are integral with the arms and the yoke respectively on said first magnetic flux conductor;

and the coil means associated with said second magnetic flux conductor is wrapped around the integral yoke of said first and second magnetic flux conductors.

8. A dam as recited in claim 6 wherein:

said third magnetic flux conductor comprises a pair of spaced-apart arms, each terminating at a respective one of said third pair of spaced-apart surfaces adjacent to and facing the top part of said pool, and a yoke connecting said arms.

9. A dam as recited in claim 8 wherein:

said yoke on the third magnetic flux conductor is integral with and a part of the yoke on the first magnetic flux conductor;

the arms and the yoke on said second magnetic flux conductor are integral with the arms and the yoke respectively on said first magnetic flux conductor;

and the coil means associated with the second magnetic flux conductor is at least part of the coil means associated with said first magnetic flux conductor.

10. A dam as recited in claim 9 wherein:

the arms and the yoke on said second magnetic flux conductor comprise downward extensions of the arms and the yoke respectively on said first magnetic flux conductor;

and the arms on said third magnetic flux conductor terminate downwardly at a location substantially above the downward termination of the arms on said second magnetic flux conductor.

11. A dam as recited in claim 9 or 10 wherein:

said coil means associated with said three magnetic flux conductors is a single coil having a pair of outer coil parts and a middle coil part;

each of said outer coil parts is physically associated with only said first and second magnetic flux conductors;

and said middle coil part is physically associated with said third magnetic flux conductor.

12. A dam as recited in claim 9 or 10 wherein:

said coil means associated with said three magnetic flux conductors comprise a pair of outer coils and a middle coil, each of said coils being separate and discrete from the other coils;

each of said outer coils is physically associated with only said first and second magnetic flux conductors;

and said middle coil is physically associated with said third magnetic flux conductor.

13. A dam as recited in claim 6 wherein:

the arms and the yoke on the second magnetic flux conductor are integral with the arms and the yoke on the first magnetic flux conductor;

said third magnetic flux conductor comprises a pair of spaced-part arms, each terminating at a respective one of said third pair of spaced-apart surfaces adjacent to and facing the top part of said pool, and a yoke connecting said arms;

and said yoke and said arms on the third magnetic flux conductor are separate and discrete from the yoke and arms on each of said first and second magnetic flux conductors.

14. A dam as recited in claim 13 wherein:

the arms and the yoke on said second magnetic flux conductor comprise downward extensions of the arms and the yoke respectively on said first magnetic flux conductor;

and the arms and the yoke on said third magnetic flux conductor terminate downwardly at a location substantially above the downward termination of the arms and the yoke on said second flux conductor.

15. A dam as recited in claim 13 or 14 wherein:

said coil means associated with the second magnetic flux conductor is the same as the coil means associated with the first magnetic flux conductor;

and the coil means associated with the third magnetic flux conductor is separate and discrete from the coil means associated with the first magnetic flux conductor.

16. A dam as recited in claim 13 or 14 wherein:

the coil means associated with each of said three magnetic flux conductors is the same as the coil means associated with the other magnetic flux conductors.

17. A dam as recited in claim 13 or 14 wherein:

said coil means associated with said three magnetic flux conductors is a single coil having a pair of outer coil parts and a middle coil part;

each of said outer coil parts is associated only with said first and second magnetic flux conductors;

and said middle coil part is associated with said third magnetic flux conductor.

18. A dam as recited in claim 2 wherein:

said coil means comprises at least one coil portion having a front surface which (a) faces said open end of the space between the casting rolls and (b) is sufficiently proximate to said open end to enable the direct generation of a horizontal magnetic field which extends through said open end to said pool of molten metal.

19. A dam as recited in claim 18 wherein:

said magnetic flux conductors comprise means for providing a low reluctance return path for the magnetic field developed at said open end of the space between the casting rolls.

20. A dam as recited in claim 19 wherein:

each of said coil means has a respective one coil portion;

said one coil portion has other surfaces in addition to said front surface thereof; and said magnetic flux conductors comprise means, enclosing said other surfaces of said one coil portion, for substantially diminishing the time-varying electric current which flows along a surface of said one coil portion other than said front surface thereof and for concentrating said current along said front surface.

21. A dam as recited in claim 20 and comprising:

non-magnetic, electrically conductive means having portions thereof substantially enclosing each of said magnetic flux conductors, other than the pair of surfaces thereon facing in the direction of said pool;

said pair of surfaces being substantially unenclosed by non-magnetic, electrically conductive means;

said non-magnetic, electrically conductive means comprising means for confining that part of a magnetic field which is outside of its low reluctance return path to substantially said open end of the space between the casting rolls.

22. A dam as recited in claim 21 wherein:

each of said first and second magnetic flux conductors comprises a pair of spaced-apart arms each terminating at a respective one of said pair of spaced-apart, unenclosed surfaces, and a yoke connecting said arms;

the arms and the yoke on said second magnetic flux conductor comprise downward extensions of the arms and the yoke respectively on said first magnetic flux conductor;

said third magnetic flux conductor comprises a pair of spaced-apart arms, each terminating at a respective one of said third pair of spaced-apart surfaces adjacent to and facing the top part of said pool, and a yoke connecting said arms;

said yoke and said arms on the third magnetic flux conductor are separate and discrete from the yoke and arms on each of said first and second magnetic flux conductors;

and the arms and the yoke on said third magnetic flux conductor terminate downwardly at a location substantially above the downward termination of the arms and the yoke on said second flux conductor.

23. A dam as recited in claim 22 wherein:

said one coil portion is located in front of said yoke of said third magnetic flux conductor and is substantially vertically coextensive with said first and second magnetic flux conductors.

24. A dam as recited in claim 23 wherein said coil means comprises:

a second coil portion comprising means located between (a) the yoke of said third magnetic flux conductor and (b) the yoke of said first and second flux conductors;

said second coil portion being substantially vertically coextensive with said first and second magnetic flux conductors;

and means for electrically connecting said two coil portions at a corresponding vertical extremity of each.

25. A dam as recited in claim 24 wherein said second coil portion comprises:

a pair of spaced-apart arms each located between (i) an arm of said third magnetic flux conductor and (ii) an arm of said first and second magnetic flux conductors, said arms of the second coil portion being vertically coextensive with the arms of said first and second magnetic flux conductors;

and a yoke connecting said pair of spaced-apart arms of the second coil portion, said yoke being located between the yoke of said third magnetic flux conductor and the yoke of said first and second magnetic flux conductors.

26. A dam as recited in claim 25 wherein:

said one coil portion has a rectangular horizontal cross section, and extends between the spaced-apart arms of said third magnetic flux conductor, and is vertically coextensive with the arms of said second coil portion;

the yoke of said second coil portion is vertically coextensive with said one coil portion;

and said electrical connecting means for the coil portions comprises a shorting element extending between said one coil portion and the yoke of the second coil portion at a corresponding vertical extremity of each.

27. A dam as recited in claim 26 wherein said coil means comprises:

a third coil portion located exteriorly of said first and second magnetic flux conductors and substantially vertically coextensive therewith;

and means for electrically connecting said second and third coil portions at a corresponding vertical extremity of each.

28. A dam as recited in claim 21 wherein:

each of said first and second magnetic flux conductors comprises a pair of spaced-apart arms each terminating at a respective one of said spaced-apart, unenclosed surfaces, and a yoke connecting said arms;

said third magnetic flux conductor comprises a pair of spaced-apart arms, each terminating at a respective one of said third pair of spaced-apart surfaces adjacent to and facing the top part of said pool, and a yoke connecting said arms;

said yoke on the third magnetic flux conductor is integral with and a part of the yoke on the first magnetic flux conductor;

the arms and the yoke on said second magnetic flux conductor are integral with the arms and the yoke respectively on said first magnetic flux conductor;

the arms and the yoke on said second magnetic flux conductor comprise downward extensions of the arms and the yoke respectively on said first magnetic flux conductor;

the arms on said third magnetic flux conductor terminate downwardly at a location substantially above the downward termination of the arms on said second magnetic flux conductor; and said one coil portion is located in front of said yoke of said magnetic flux conductors and is substantially vertically coextensive with said first and second magnetic flux conductors.

29. A dam as recited in claim 28 wherein:

said one coil portion is composed of a middle part and two outer parts, each having a substantially rectangular horizontal cross-section;

said middle part is located between the spaced-apart arms of said third magnetic flux conductor;

and each of said outer parts is located between an arm of said third magnetic flux conductor and an arm of said first and second magnetic flux conductors.

30. A dam as recited in claim 29 wherein said coil means comprises:

another coil portion located exteriorly of said first and second magnetic flux conductors and substantially vertically coextensive therewith;

and means for electrically connecting said other coil portion with each of said parts of said one coil portion at a corresponding vertical extremity of each.

31. A dam as recited in claim 1 or 2 wherein:

said strip caster is devoid of any functional mechanical expedient for containing said pool of molten metal at the open end of the space between the casting rolls.

32. A dam as recited in claim 31 and comprising:

a refractory heat shield disposed between (i) said dam and (ii) said open end of the space between said casting rolls;

said heat shield being spaced away from said open end.

33. A dam as recited in claim 1 and comprising:

one coil associated with said first magnetic flux conductor;

another coil associated with said third magnetic flux conductor;

means for providing a time-varying current for said one coil;

and means for providing a time-varying current for said other coil and which is in phase with said current for the one coil.

34. A dam as recited in claim 1 and comprising:

one coil associated with said first magnetic flux conductor;

another coil associated with said third magnetic flux conductor;

means for providing a time-varying current for said one coil;

means for providing a time-varying current for said other coil;

said coils and said magnetic flux conductors comprising means, responsive to the flow of said currents through said coils, for developing, at said relatively wide air gap, a horizontal magnetic field for electromagnetically confining said pool at its top part;

and means for phase shifting at least one of said time-varying currents relative to the other to adjust the confinement force exerted by the horizontal magnetic field developed at said relatively wide air gap.

35. A dam as recited in claim 1 wherein:

said third magnetic flux conductor and the coil means associated therewith comprise means for helping to shape the horizontal magnetic field developed at the top part of said molten metal pool.

36. A method for electromagnetically confining a vertically disposed pool of molten metal at the open end of a vertically extending space between two horizontally disposed, counter-rotating casting rolls in a continuous strip caster, said pool having a relatively wide top part and a relatively narrow bottom part, said method comprising;

providing a first magnetic flux conductor having a first pair of spaced-apart surfaces adjacent to and facing toward said pool of molten metal, said first pair of surfaces defining a relatively wide air gap adjacent said top part of said molten metal pool;

providing a second magnetic flux conductor having a second pair of spaced-apart surfaces adjacent to and facing toward said pool, said second pair of surfaces defining a relatively narrow air gap adjacent said bottom part of said pool at the nip between said rolls;

providing a third magnetic flux conductor having a third pair of spaced-apart surfaces facing toward said pool adjacent the top part of said pool;

disposing said pair of surfaces of the third flux conductor between said pair of surfaces of said first magnetic flux conductor, in said wide air gap;

providing coil means in association with each of said magnetic flux conductors;

and flowing time-varying electric current through said coil means to develop, at said air gaps, horizontal magnetic fields to confine said pool of molten metal at said open end of the space between said casting rolls.

37. A method as recited in claim 36 wherein:

the flowing of time-varying current through the coil means associated with said second magnetic flux conductor develops, at said relatively narrow air gap, a horizontal magnetic field for confining said pool at said nip when the pool is at its maximum height;

the flowing of time-varying current through the coil means associated with said first magnetic flux conductor develops, at said relatively wide air gap, a horizontal magnetic field comprising magnetic flux;

the flowing of time-varying current through the coil means associated with said third magnetic flux conductor develops at said relatively wide air gap, additional magnetic flux which augments at least part of the magnetic flux developed by the flowing of current through said coil means associated with said first magnetic flux conductor;

and the flowing of current through the coil means associated with the first and third magnetic flux conductors develops, at said relatively wide air gap, a horizontal magnetic field for confining said pool at its top part when the pool is at its maximum height.

38. A method as recited in claim 36 or 37 and comprising:

providing, as said coil means, a pair of separate coils, one coil for each of said first and third magnetic flux conductors;

flowing a time-varying current through one of said coils;

and providing a time-varying current for the other of said coils which is in phase with the time-varying current flowing through said one coil.

39. A method as recited in claim 36 or 37 and comprising:

providing, as said coil means, a pair of separate coils, one coil for each of said first and third magnetic flux conductors;

flowing a time-varying current through each of said coils;

and phase shifting the time-varying current flowing through one of said coils, relative to the time-varying current flowing through the other of said coils, to adjust the confinement force exerted by the horizontal magnetic field developed at said wide air gap.

40. A method as recited in claim 36 or 37 and comprising:

providing, as said coil means, a pair of separate coils, a first coil for said first and second magnetic flux conductors and another coil for said third magnetic flux conductor;

adjusting said time-varying current flowing through said first coil to obtain confinement at said bottom part of said pool;

and adjusting the time-varying current flowing through said other coil to obtain confinement at said top part of the pool.

41. A method as recited in claim 40 and comprising:

adjusting the time-varying currents flowing through both of said coils to optimize the confinement field developed at said wide air gap.

42. A method as recited in claim 36 and comprising:

employing said third magnetic flux conductor, and the coil means associated therewith, to help shape the topography of the horizontal magnetic field at the top part of said molten metal pool.

* * * * *

UNITED STATES PATENT AND TRADEMARK OFFICE

CERTIFICATE OF CORRECTION

PATENT NO. : 5,695,001

DATED : December 9, 1997

INVENTOR(S) : Kenneth E. Blazek and Walter F. Praeg

It is certified that error appears in the above-indentified patent and that said Letters Patent is hereby corrected as shown below:

Col. 11, line 8, after "73" add --, 74--.

Col. 15, line 50, after "-" delete --document--.

Signed and Sealed this

Eleventh Day of August 1998

Bruce Lehman

*Attest:*

BRUCE LEHMAN

*Attesting Officer*

*Commissioner of Patents and Trademarks*